United States Patent [19]

Baker

[11] 4,133,058

[45] Jan. 9, 1979

[54] AUTOMATED POOL LEVEL AND SKIMMING GUTTER FLOW CONTROL SYSTEM

[76] Inventor: William H. Baker, 30 Honeysuckle Woods, Clover, S.C. 29710

[21] Appl. No.: 838,700

[22] Filed: Oct. 3, 1977

Related U.S. Application Data

[63] Continuation-in-part of Ser. No. 663,161, Mar. 2, 1976, abandoned, which is a continuation-in-part of Ser. No. 640,825, Dec. 15, 1975, abandoned.

[51] Int. Cl.[2] ..... E04H 3/16; E04H 3/20

[52] U.S. Cl. ..... 4/172.17

[58] Field of Search ..... 4/172, 172.15, 172.16, 4/172.17; 210/169, 102, 104, 105, 123, 126; 137/386

[56] References Cited

U.S. PATENT DOCUMENTS

| | | | |
|---|---|---|---|
| 1,800,378 | 4/1931 | Everson | 210/169 X |
| 2,809,752 | 10/1957 | Leslie | 4/172.17 X |
| 3,386,107 | 6/1968 | Whitten | 4/172 |
| 3,537,111 | 11/1970 | Whitten | 4/172.17 |
| 3,668,713 | 6/1972 | Baker | 4/172.17 |
| 3,739,405 | 6/1973 | Schmidt | 4/172.15 |
| 3,815,160 | 6/1974 | Baker | 4/172 X |
| 3,848,627 | 11/1974 | Page | 4/172.17 |
| 3,895,402 | 7/1975 | Page | 4/172.17 |
| 3,908,207 | 9/1975 | Van den Broek | 4/172.17 |

FOREIGN PATENT DOCUMENTS

| | | | |
|---|---|---|---|
| 16917 | 3/1934 | Australia | 4/172.17 |

*Primary Examiner*—Stuart S. Levy

[57] ABSTRACT

A fully automated pool level and skimming gutter flow control system is provided, automatically establishing and controlling pool level and skimming gutter flow under both normal and extraordinary pool use conditions, sensing changes in water level and water activity, and actuating appropriate response mechanisms controlling water feed and skimming gutter drain flow, as well as make-up water and rate of recirculation of the water between the pool and the filtration system.

60 Claims, 11 Drawing Figures

AUTOMATED POOL LEVEL AND SKIMMING GUTTER FLOW CONTROL SYSTEM

This application is a continuation-in-part of Ser. No. 663,161 filed Mar. 2, 1976, now abandoned and which is a continuation-in-part of Ser. No. 640,825, filed Dec. 15, 1975, and now abandoned.

Automatic control at all times of the water level in a pool requires prompt response to changes in operating conditions, and is not easy to achieve. Many attempts have been made, but a fully automated response to all use conditions has not in fact been obtained.

Establishment and maintenance of the water level in a pool when the pool is quiescent is relatively easy. One system for automatically maintaining pool level, sensing pool level by a float in a surge and level control tank, and feeding make-up water to the pool by a float-operated valve, is described in U.S. Pat. No. 3,386,107 to G. R. Whitten Jr., patented June 4, 1968. It is desirable of course to avoid placing a float directly in the pool, since not only would a float be in the way of swimmers, but the float would also be subject to changes in water level due to wave action. These problems are avoided by placing the float in a separate surge and level control tank, connected to the pool below the surface, so that the control responds only to static pool level. When the static level is below a predetermined level, make-up water is added even though the pool surface may be turbulent. In the system of this patent, the make-up water is added to the control chamber in the tank, in which the float sinks to detect a low water level, and excess water is also withdrawn by overflow or drain provided through the control tank. However, as noted by Whitten Jr. in a later U.S. Pat. No. 3,537,111 patented Nov. 3, 1970, the cost of such an elaborate surge and level control tank adds substantially to the total construction cost of the pool.

A further system noted by Whitten Jr. in U.S. Pat. No. 3,537,111 is to provide a sump separated from the pool by a ledge which sets a level for overflow, and a make-up water supply valve feeding directly into the sump under the control of a float. A drain valve is connected to the same float for draining the sump to a recirculating pump whenever the sump tends to overfill. However, this system does not correct flooding of the sump to the pool level by rain or overfilling, and no peripheral gutter is provided in this system, which also requires the construction of a separate sump tank which has to be placed at pool side, rather than located remotely at a location which would be both more convenient and less obstructive of the deck around the pool.

Accordingly, in U.S. Pat. No. 3,537,111, patented Nov. 3, 1970, Whitten Jr. proposed a modified system in which all water level sensors sense water level in the drainage gutter, and not in the pool. The level of drainage flow in the single peripheral gutter is detected at one level or a range of levels. The gutter has an overflow lip or weir for skimming flow at the desired height, and delivers overflow to a recirculating pump and filter, which may be also draw water from drains under the pool surface. The detecting means controls a valve in a make-up water supply line which either feeds the pool directly, or feeds the recirculating pump, if prefiltration is desired. The control is arranged to open the make-up valve, if the drainage flow falls below a level that will guarantee maintenance of continuous overflow all around the periphery of the pool, taking the provision of a hydraulic gradient in the gutter into account. If the drainage flow rises beyond a normal operating level, which is sufficiently lower than the gutter lip to allow ample space in the gutter to receive abnormal flow caused by pool surge, the control closes the make-up valve and discontinues the supply to the pool.

Means is also provided for increasing the rate of drainage of the gutter under flooding conditions, detecting the level of the drainage flow to control the main drain valve. The control is arranged to partially close the main drain valve to reduce the proportion of the recirculating flow which is drawn from the main drain whenever the gutter flow substantially fills the gutter space reserved for surge and approaches the level of the overflow drain pipe. The effect of this is to increase the rate of flow taken by the recirculating pump from the gutter, and thus hasten a drop in the drainage overflow in the gutter to a suitable operating level. As this level returns to normal, the control reopens the main drain valve to restore the original proportioning of the recirculating flow taken from the gutter and the pool.

The system does however have an inadequate gutter capacity to respond to high gutter flooding conditions.

Higher than normal pool levels, substantially higher than the overflow lip of the gutter, must be prevented from entering the gutter, therefore, by covering the gutter with a grille having drain holes whose total area is calculated to admit only the maximum recirculation flow rate that can be handled by the gutter. Such water is retained on the grille, and accordingly washes back to the pool without entering the gutter, which is undesirable, since this washes dirt and debris collected on the grille back into the pool, and accordingly fails to meet modern health code requirements.

In order to prevent this, it is necessary to provide a gutter system of considerably increased capacity, such as a double gutter of the type provided, for example, in U.S. Pat. Nos. 3,668,712, 3,668,713, 3,668,714 and 3,815,160 to Baker. However, the control system of U.S. Pat. No. 3,537,111 is not suitable for use in a double gutter pool.

In accordance with the present invention, a fully automated water level and skimming flow perimeter gutter control system for swimming pools is provided, comprising a gutter receiving overflow, including surge flow and/or skimming flow, across the top of the perimeter gutter and adequate for normal and surge flow conditions, and optionally, a second gutter receiving skimming flow and also providing additional gutter capacity for extraodinary overflow, including relief flow from the first gutter in the event of considerable activity in the pool, in combination with a level-sensing pool and overflow control system operating from the level of water in the pool and from the level of water in the pool overflow, such as in the gutter conduit, or in a balance tank or a vacuum filter tank, to control the skimming flow and water recirculation between the pool and the gutter, and feed from a water-make-up supply.

Two sensors are provided to control normal pool water level. A first overflow sensor senses a first level of water in the overflow, such as in the gutter or balance tank or vacuum filter tank, corresponding to below-normal skimming flow. A first pool sensor senses the level of the water in the pool. Whenever the skimming flow is below a predetermined level, one of the first or second sensors is arranged to open a make-up valve controlling feed of fresh water from a supply or the water main. Whenever the pool water level reaches a predetermined level at which skimming flow via surge weirs or a skimming gutter proceeds, and overflows into the gutter, the other of the first or second sensors is arranged to close the make-up water valve. This equilibrium condition continues while skimming flow remains at a rate corresponding to a quiescent pool condition.

The first overflow sensor disposed downstream of the pool, such as in the gutter, is inactive while normal water overflow, as reflected, for example, in the water level in the gutter, is maintained under normal skimming flow through the surge weirs or skimming gutter, but whenever the water level in the pool falls, the overflow (i.e. the skimming flow) decreases to below this predetermined level, which condition is sensed by the first overflow sensor. The pool sensor can also sense that the pool level is below the level at which skimming flow proceeds. Thus either one of the two sensors can open the make-up valve, and replenish the water supply. When the pool water level returns to normal, the pool can be sensed by the first sensor, or alternatively by the first overflow sensor, as skimming flow. Thus, either one of the two sensors can close the makeup water valve.

Any increase in pool activity above the quiescent condition results in a greater-than-normal skimming flow through the surge weirs, and/or skimming gutter, and this in turn causes the water overflow level to rise, in the gutter and elsewhere downstream.

In the event the gutter system includes one or more surge weirs, arranged in weir passages, a second overflow sensor is provided, such as in the gutter, responsive to a second overflow water level, corresponding to a low activity pool condition, in which the overflow level is above the normal skimming flow level sensed in the pool by the first pool sensor. When the overflow level reaches the level of the second overflow sensor, the sensor actuates a mechanism closing off the surge weirs, arresting skimming flow through the weirs, and retaining the water in the pool, but allowing skimming flow and/or surges to proceed across the top of the perimeter gutter, into the gutter.

Light pool activity, if increased further, will increase the overflow water level such as in the gutter to a level corresponding to moderate pool activity. If a two-gutter system is provided, the water level in the first gutter will eventually reach the flooding level, and thus an overflow connection is provided between the first and second gutters, so that such water instead of flooding the first gutter and returning to the pool flows from the first gutter to the second gutter.

Under moderate pool activity, more water flows into the gutter, and eventually taxes the normal water recirculation system, which receives flow not only from the gutter but also from the main drain in the pool. Consequently, the overflow water level, such as in the gutter, rises still further, until it encounters, at a third overflow water level, a third sensor. This sensor is in operating connection with the main drain valve, and when this water level is reached, the water recirculation system capacity for gutter flow is increased by closing off the main drain valve, causing all recirculation water between the pool and the pool recirculation system to flow into the system from the gutter. If the main drain were not cut off, the recirculation system would be unable to accommodate the increased gutter flow, and the gutter flow would begin to back up in the gutter system. Consequently, this sensor prevents flooding of the gutters and back-wash to the pool under the increased gutter flow, as a result of this higher level of activity.

Alternatively, or in addition, recirculation flow can be increased by opening a recirculating flow throttling control valve on the return line of the recirculation system. This valve can at normal quiescent or light pool activity provide a normal recirculation flow, but upon demand, at moderate or heavy pool activity provide a higher recirculation flow. The throttling valve thus makes it possible to design the recirculation system to accommodate any excess flow above the normal recirculation rate, as may be required according to the amount of pool activity to be expected, or the amount of skimming flow across the top of the perimeter gutter.

To avoid the restriction of a limited flow through a filter, a by-pass line can be incorporated to allow some or all excess flow to bypass the filter.

Accordingly, upon a further increase in pool activity to the maximum, or operation of the pool at the rim flow level, providing skimming flow across the top of the gutter, the amount of overflow into the gutter increases. still further. Eventually, such activity raises the overflow water level such as in the gutter to a fourth overflow water level, at which the capacity of the recirculation system is exceeded, and must be increased further to prevent gutter flooding and wash back. At this point a fourth overflow sensor is actuated, and this sensor opens the recirculating flow throttling control valve on the return line of the recirculation system, to increase the amount of water drawn through the filter, and/or opens a bypass line to bypass the filter, so as to permit the recirculation system to accommodate the excess overflow generated under such conditions.

The several sensors can be double-acting, i.e., actuated at their predetermined water level, whether that level is reached by a declining flow or by a rising flow, or single-acting, in which case one set of sensors responds to rising level and a second set of sensors can be used if desired responding to declining flow, or a combination of both. Consequently, a declining flow can be made to reverse the sequence of actuation response noted above.

Accordingly, the control system in accordance with the invention makes it possible automatically to accommodate any amount of pool activity without gutter flooding or washing back of debris and contaminants in the gutters into the pool, permitting skimming flow through surge weirs or over the rim of the perimeter gutter, as may be desired.

One embodiment of the automated pool perimeter skimming gutter water level control system of the invention accordingly comprises, in combination, a gutter conduit for dispostion about the perimeter of a swimming pool, and adapted to carry water at a level below a predetermined level of water in the swimming pool; a retaining wall on the pool side of the gutter conduit, over the top of which wall water may flow from the pool into the gutter conduit, the top of the wall being placed at a height to maintain a predetermined water level in the pool, to provide a skimming flow of water over the top at such predetermined water level in the pool, and to allow excessive flows, wave actions and surges to flow over the top of the wall into the gutter conduit; a water cleaning and recirculating system for collecting water from the pool and water flowing into and along the gutter conduit, cleaning it, and returning it to the pool; a first overflow sensor sensing a first water level in the overflow downstream of the pool corresponding to a less than the predetermined water level in the pool, and arranged to feed water to the pool; a first pool sensor sensing a predetermined water level in the pool characteristic of normal quiescent pool skimming flow and arranged to stop water feed initiated by the first overflow sensor; and a second overflow sensor sensing a higher level in the overflow downstream of the pool characteristic of a high degree of water flow wave action and surges into the gutter conduit, and arranged to increase water recirculation system capacity to recirculate such increased overflow and prevent wash-back from a gutter conduit to the pool.

A preferred embodiment of the automated pool perimeter skimming gutter level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; the top of the wall being placed at a height to maintain a predetermined water level in the pool, to provide a skimming flow of water over the top of the wall at such predetermined water level in the pool, and to allow excessive flows, wave actions and surges to flow over the top of the wall into the gutter conduit; a water cleaning and recirculating system for collecting water from the pool and water flowing into and along the gutter conduits, cleaning it, and returning it to the pool; and including a water recirculation throttling valve controlling the capacity for recirculating water flow of the water cleaning and recirculating system; a first overflow sensor sensing a first water level in the overflow downstream of the pool corresponding to a less than the predetermined water level in the pool, and arranged to feed water to the pool; a first pool sensor sensing a predetermined water level in the pool characteristic of normal quiescent pool skimming flow and arranged to stop water feed initiated by the first overflow sensor; and a second overflow sensor sensing a higher level in the overflow characteristic of a high degree of water flow, wave action and surges into the gutter conduit, and arranged to adjust the water recirculation throttling valve to increase recirculation system capacity to accommodate such increased overflow, and prevent wash-back from a gutter conduit to the pool.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flow, wave actions and surges up to a predetermined minimum, while allowing excessive flows, wave actions and surges to flow over the top of the wall into the gutter conduit; a water cleaning and recirculating system for collecting water from the pool and water flowing into and along the gutter conduit, cleaning it, and returning it to the pool; a first gutter sensor sensing a first water level in the gutter corresponding to a less than the predetermined water level in the pool, and arranged to feed water to the pool; a first pool sensor sensing a predetermined water level in the pool characteristic of normal quiescent pool skimming flow and arranged to stop water feed initiated by the first gutter sensor; and a second gutter sensor sensing a higher level in the gutter characteristic of a high degree of water flow wave action and surges into the gutter conduit, and arranged to increase water recirculation system capacity to recirculate such increased gutter flow and prevent wash-back from a gutter conduit to the pool.

A preferred embodiment of the automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; the top of the wall being placed at a height to maintain a predetermined water level in the pool, to provide a skimming flow of water over the top of the wall at such predetermined water level in the pool, and to allow excessive flows, wave actions and surges to flow over the top of the wall into the gutter conduit; a water cleaning and recirculating system for collecting water from the pool and water flowing into and along the gutter conduits, cleaning it, and returning it to the pool; and including a water recirculation throttling valve controlling the capacity for recirculating water flow of the water cleaning and recirculating system; a first gutter sensor sensing a first water level in the gutter corresponding to a less than the predeterined water level in the pool, and arranged to feed water to the pool; a first pool sensor sensing a predetermined water level in the pool characteristic of normal quiescent pool skimming flow and arranged to stop water feed initiated by the first gutter sensor; and a second gutter sensor sensing a higher level in the gutter characteristic of a high degree of water flow, wave action and surges into the gutter conduit, and arranged to adjust the water recirculation throttling valve to increase recirculation system capacity to accommodate such increased gutter flow, and prevent wash-back from a gutter conduit to the pool.

Another embodiment of automated pool perimeter skimming gutter water level control system of the invention comprises, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; a first overflow sensor sensing a first water level in the overflow downstream of the pool corresponding to a less than the predetermined water level in the pool, and arranged to feed water to the pool; a first pool sensor sensing the predetermined water level in the pool characteristic of normal quiescent pool skimming flow and arranged to stop water feed initiated by the first overflow sensor; a second overflow sensor sensing a second higher level in the overflow downstream of the pool characteristic of a low threshold of pool activity but excessive weir skimming flow, and arranged to close at least one weir; and a third overflow sensor sensing a third higher level in the overflow downstream of the pool characteristic of a high degree of water flow, wave action and surges into the gutter conduit, and arranged to increase water recirculation system capacity to recirculate such increased overflow and prevent wash-back from a gutter conduit to the pool.

A preferred embodiment of twin-gutter automated pool perimeter skimming gutter water level control system of the invention comprises, in combination, a first gutter conduit for disposition about the perimeter of a swimming pool, and adapted to carry water at a level below predetermined level of water in the swimming pool; a second gutter conduit for disposition about the perimeter of a swimming pool, and adapted to carry water at a level below a predetermined level of water in the swimming pool; a retaining wall on the pool side of the gutter conduit, over the top of which wall water may flow from the pool into a gutter conduit; the top of the wall being placed at a height to maintain a predetermined water level in the pool, to provide a skimming flow of water at such predetermined water level in the pool, and to allow excessive flows, wave actions and surges to flow over the top of the wall into a gutter conduit; a water cleaning and recirculating system for collecting water from the pool and water flowing into and along the first and second gutter conduits, cleaning it, and returning it to the pool; a first overflow sensor sensing a first water level in the overflow downstream of the pool corresponding to a less than the predetermined water level in the pool, and arranged to feed water to the pool; a first pool sensor sensing the predetermined water level in the pool characteristic of normal quiescent pool skimming flow and arranged to stop water feed initiated by the first overflow sensor; and a second overflow sensor sensing a second higher level in the overflow downstream of the pool characteristic of a high degree of water flow, wave action and surges into the gutter conduit, and arranged to increase water recirculation system capacity to recirculate such increased overflow and prevent wash-back from a gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; the top of the wall being placed at a height to maintain a predetermined water level in the pool, to provide a skimming flow of water over the top of the wall at such predetermined water level in the pool, and allow excessive flows, wave actions and surges to flow over the top of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first overflow sensor sensing a first water level in the overflow downstream of the pool corresponding to a less than the predetermined water level in the pool, and arranged to feed water to the pool; a first pool sensor sensing a predetermined water level in the pool characteristic of normal quiescent pool skimming flow and arranged to stop water feed initiated by the first overflow sensor; and a second overflow sensor sensing a higher level in the overflow downstream of the pool characteristic of a high degree of water flow, wave action and surges into the first gutter conduit, and arranged to adjust the water circulation throttling valve to increase recirculation system capacity to accommodate such increased overflow, and prevent wash-back from a gutter conduit to the pool.

Another embodiment of automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; a first overflow sensor sensing a first water level in the overflow downstream of the pool corresponding to a less than the predetermined water level in the pool, and arranged to feed water to the pool; a first pool sensor sensing the predetermined water level in the pool corresponding to a second higher level in the overflow downstream of the pool characteristic of normal quiescent pool skimming flow and arranged to stop water feed initiated by the first overflow sensor; a second overflow sensor sensing a third higher level in the overflow downstream of the pool characteristic of a low threshold of pool acitivity but excessive weir skimming flow, and arranged to close at least one weir; and a fourth overflow sensor sensing a fourth higher level in the overflow downstream of the pool characteristic of a high degree of water flow, wave action and surges into the first gutter conduit, and arranged to increase water recirculation system capacity to recirculate such increased overflow and prevent wash-back from a gutter conduit to the pool.

A preferred embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a second gutter conduit for disposition about the perimeter of a swimming pool, and adapted to carry water at a level below a predetermined level of water in the swimming pool; a retaining wall on the pool side of the gutter conduit, over the top of which wall water may flow from the pool into a gutter conduit; the top of the wall being placed at a height to maintain a predetermined water level in the pool, to provide a skimming flow of water at such predetermined water level in the pool, and to allow excessive flows, wave actions and surges to flow over the top of the wall into a gutter conduit; a water cleaning and recirculating system for collecting water from the pool and water flowing into and along the first and second gutter conduits, cleaning it, and returning it to the pool; a first gutter sensor sensing a first water level in a gutter corresponding to a less than the predetermined water level in the pool, and arranged to feed water to the pool; a first pool sensor sensing the predetermined water level in the pool characteristic of normal quiescent pool skimming flow and arranged to stop water feed initiated by the first gutter sensor; and a second gutter sensor sensing a second higher level in the gutter characteristic of a high degree of water flow, wave action and surges into the gutter conduit, and arranged to increase water recirculation system capacity to recirculate such increased gutter flow and prevent wash-back from a gutter conduit to the pool.

Another embodiment of twin-gutter automated pool perimeter skimming gutter water level control system of the invention comprises, in combination, a first gutter conduit for disposition about the perimeter of a swimming pool, and adapted to carry water at a level below a predetermined level of water in the swimming pool; a retaining wall on the pool side of the first gutter conduit, over the top of which wall may flow from the pool into the first gutter conduit; a second gutter conduit for disposition about the perimeter of a swimming pool, and adapted to carry water at a level below a predetermined level of water in the swimming pool; the top of the wall being placed at a height to maintain a predetermined water level in the pool, to provide a skimming flow of water over the top of the wall at such predetermined water level in the pool, and allow excessive flows, wave actions and surges to flow over the top of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; a first gutter sensor sensing a first water level in a gutter corresponding to a less than the predetermined water level in the pool, and arranged to feed water to the pool; a first pool sensor sensing a predetermined water level in the pool characteristic of normal quiescent pool skimming flow and arranged to stop water feed initiated by the first gutter sensor; and a second gutter sensor sensing a higher level in the gutter characteristic of a high degree of water flow, wave action and surges into the first gutter conduit, and arranged to adjust the water recirculation throttling valve to increase recirculation system capacity to accommodate such increased gutter flow, and prevent wash-back from a gutter conduit to the pool.

Another embodiment of automated pool perimeter skimming gutter water level control system of the invention comprises, in combination, a first gutter conduit for disposition about the perimeter of a swimming pool, and adpated to carry water at a level below a predetermined level of water in the swimming pool; a retaining wall on the pool side of the gutter conduit, over the top of which wall water may flow from the pool into the gutter conduit; a second gutter conduit for disposition about the perimeter of a swimming pool, and adapted to carry water at a level below a predetermined level of water in the swimming pool; at least one surge weir disposed through the retaining wall below the top thereof, at a height to maintain a predetermined water level in the pool, and to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; a first sensor sensing a first water level in the second gutter corresponding to a less than the predetermined water level in the pool, and arranged to feed water to the pool; a second sensor sensing the predetermined water level in the pool corresponding to a second higher level in the second gutter characteristic of normal quiescent pool skimming flow and arranged to stop water feed initiated by the first sensor; a third sensor sensing a third higher level in the second gutter characteristic of a low threshhold of pool activity but excessive weir skimming flow, and arranged to close at least one weir; and a fourth sensor sensing a fourth higher level in the second gutter characteristic of a high degree of water flow, wave action and surges into the first gutter conduit, and arranged to increase water recirculation system capacity to recirculate such increased gutter flow and prevent wash-back from a gutter conduit to the pool.

A weir or weirs for skimming flow is not essential, and can be omitted. A skimming flow over the top of the retaining wall can be used instead, as in U.S. Pat. No. 3,815,160. It is also possible to use skimming slots, as in U.S. Pat. Nos. 3,668,712 and 3,668,714, the slots feeding water directly into the second gutter conduit.

The overflow level can be sensed by overflow sensors at any position downstream of the pool where a water level correlated with pool activity and skimming flow exists, and can be detected. One such location is in the gutter. If there be more than one gutter, the second gutter downstream of the first gutter is preferred, but any gutter can be used. Another location is in a balance tank or vacuum filter tank before the pump, receiving gutter flow, in the water recirculation system.

The water level sensing and control system of the invention is applicable to any design of single or multiple gutter perimeter gutter system.

U.S. Pat. No. 3,668,712 to William H. Baker dated June 13, 1972, provides a perimeter skimming gutter for swimming pools including a gutter conduit for disposition about the perimeter of a swimming pool and adapted to carry water at a level below a predetermined level of water in the swimming pool, a retaining wall on the pool-side of the conduit, over the top of which wall water may flow from the pool into the gutter conduit, and a plurality of narrow elongated substantially horizontally disposed openings through the wall at a height to maintain a predetermined water flow, the top of the wall being spaced above the openings at a height to retain the pool water within the pool perimeter at water flows, wave actions and surges up to a predetermined maximum, while allowing excessive water flows, wave actions and surges beyond such maximum to flow over the top of the wall into the gutter conduit.

U.S. Pat. No. 3,668,714 to William H. Baker dated June 13, 1972, provides a nonflooding perimeter skimming gutter for swimming pools including a first gutter conduit for disposition about the perimeter of a swimming pool, and adapted to carry water at a level below a predetermind level of water in the swimming pool, a retaining wall on the pool-side of the first gutter conduit over the top of which wall a skimming flow of water may run from the pool into the first gutter conduit, a second gutter conduit adapted to carry water at a level below a predetermined level of water in the first gutter conduit, and a fluid flow connection between the two gutter conduits at such level and below the top of the retaining wall allowing water flow from the first gutter conduit into the second gutter conduit whenever the water level on the first gutter conduit reaches the fluid flow connection, thereby inhibiting filling of the first gutter conduit appreciably above such level.

Both skimming gutter designs are quite satisfactory for most sizes of swimming pool. If their unusually large gutter capacity can at times be exceeded, then the gutter of No. 3,815,160 to Wilian H. Baker, dated June 11, 1974, can be used.

This nonflooding perimeter skimming gutter wall permits an adequate skimming action at all times, and also provides for virtually unlimited surge capacity when the pool is in use, without the possibility of the gutter's flooding, or dirt in the gutter's being washed back into the pool. This is accomplished by combining a second gutter conduit within a peripheral wall of the swimming pool, making available for gutter flow the internal volume of the wall, in fluid flow connection with the first gutter conduit, and adapted to receive water from the first gutter conduit whenever the level of water in that gutter exceeds a predetermined maximum, established at the level of the fluid flow connection therebetween. This fluid flow connection is below the top of the retaining wall, so that the water level in the first gutter conduit cannot reach the top of the retaining wall. The second gutter conduit within the wall is entirely separate from the first, and is designed to provide an ample reserve flow capacity to accommodate any heavy or surge action that may be likely to be encountered. The fluid flow connection between the gutter conduits can be arranged to skim the dirt off the top of the first gutter trough, thus assisting in preventing this dirt from being washed back into the pool.

In this gutter system, the water level in the pool is normally maintained at the level at the top of the retaining wall, which consequently serves as a skimmer gutter at the pool perimeter. The fluid flow connection may constitute a second skimming flow outlet, supplementing and continuing the skimming action of the first.

The term "conduit" as used herein is inclusive of open conduits or troughs as well as partially or wholly enclosed conduits.

In a preferred embodiment of the invention the first gutter conduit is an open trough, with at least one fluid flow connection with the second gutter conduit in the form of one of a plurality of openings at the predetermined maximum level of water in the first gutter conduit.

The second gutter conduit preferably is a closed conduit. The second gutter conduit can be within any peripheral wall of the pool. It can, for example, be within the peripheral pool-side retaining wall. It can also be within a peripheral external wall of the gutter, on the side away from the pool.

In a preferred embodiment of the invention, a water-feed conduit is provided in the gutter for feed of fresh water into the pool. This conduit is preferably an integral part of the nonflooding perimeter skimming gutter, at the pool-side retaining wall, admitting water to the pool through the pool-side retaining wall.

In the case where the two gutters are separated by a common wall, the fluid flow connection between the two gutters can be of any configuration, and is in sufficient number and at a high enough level to provide for an adequate flow capacity, to prevent the water level in the first gutter conduit from appreciably exceeding the height of the overflow connection under any water surge or wave conditions in the pool.

The level of the overflow connections with respect to the bottom of the first gutter conduit can be adjustable, so as to provide adjustment of the water level permitted in the first gutter conduit before flow via the overflow connections into the second gutter conduit commences. This adjustment can be provided for by forming the overflow connections as vertical slots or with an extended vertical height, and disposing a movable barrier member over the overflow connections with the opening or openings of the desired size and shape.

A preferred embodiment of the invention is shown in the drawings in which.

Figure 1:
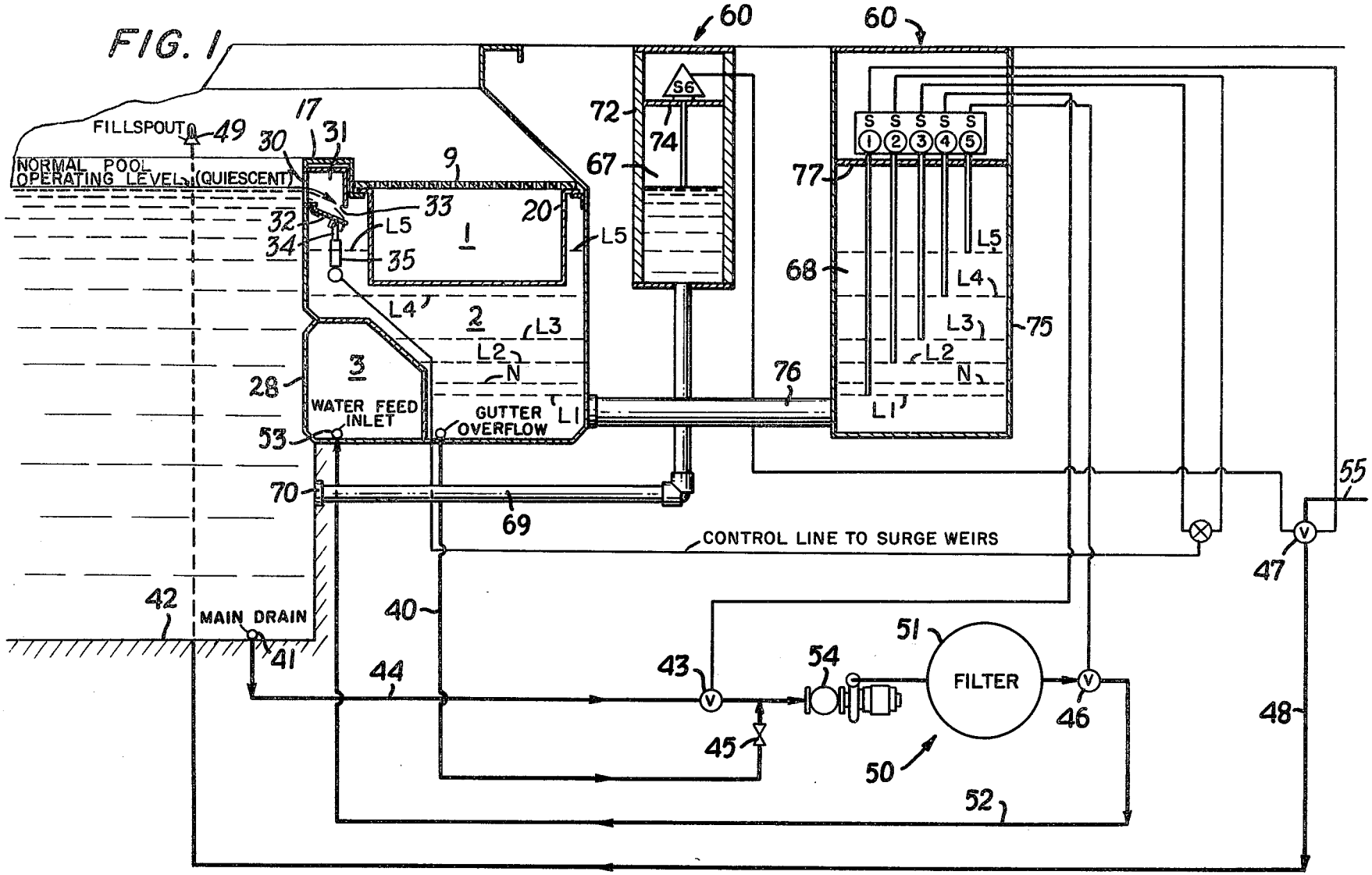
FIG. 1 is a pool water flow circuit diagram, showing a twingutter pool perimeter water recirculation system with the automated control system of the invention imposed thereon.
Figure 10:
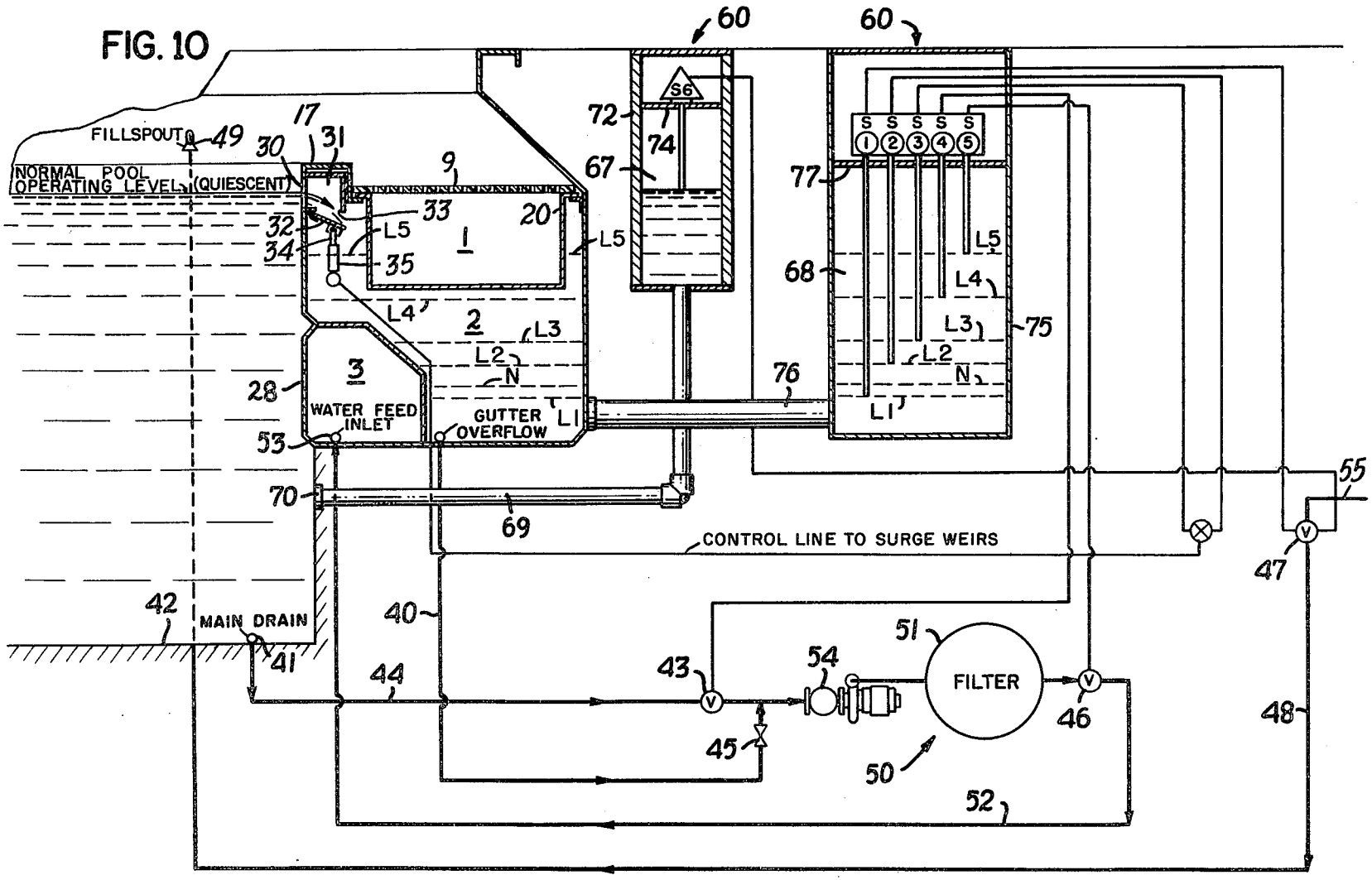
Figure 11:
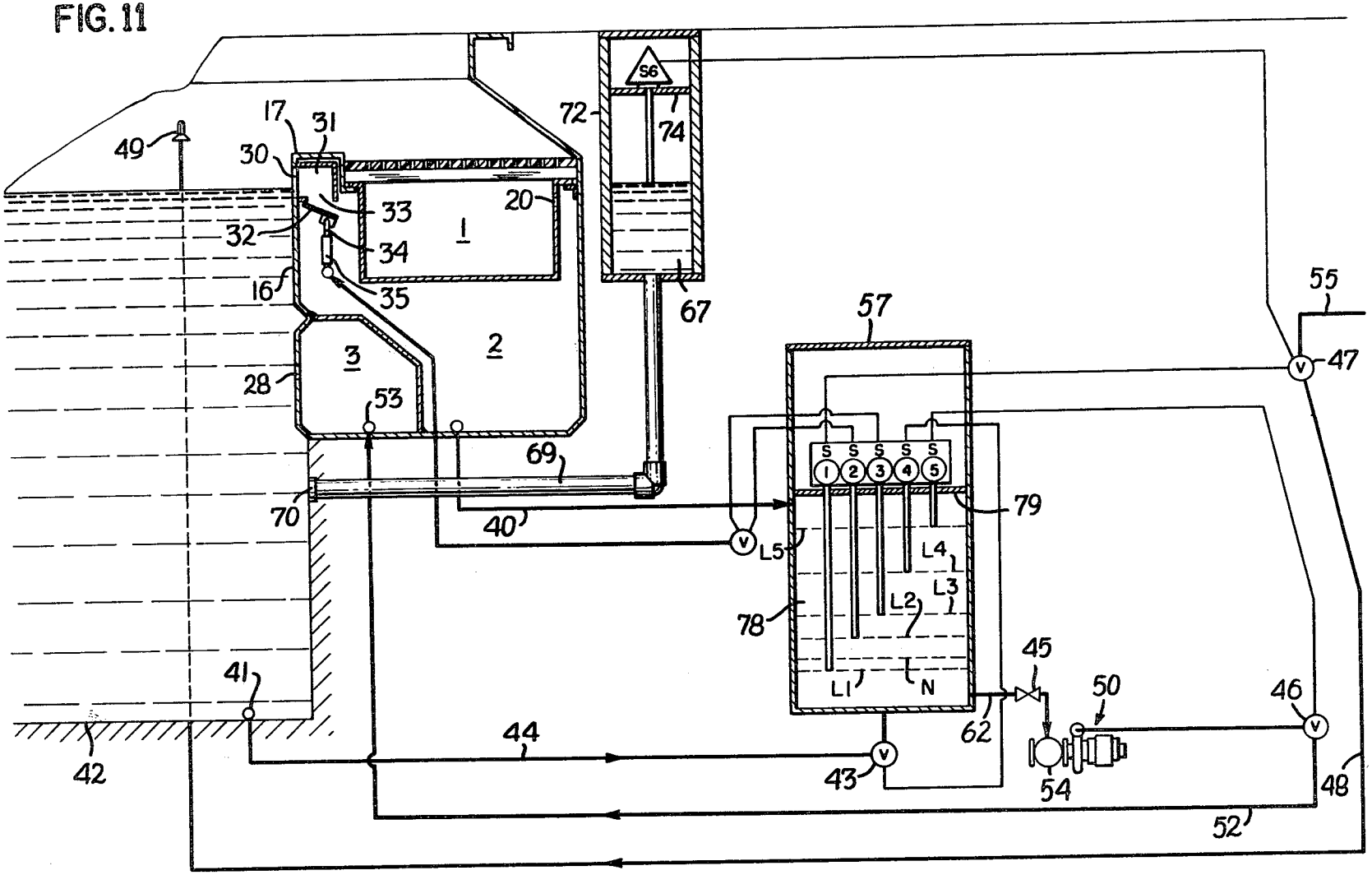

FIG. 10 is a pool water flow circuit diagram showing a twin-gutter pool perimeter water recirculation system with the automated control system of the invention, similar to FIG. 1 but with the functions of sensors S1 and S6 reversed; and FIG. 11 is a pool water circuit diagram, showing a double-gutter pool perimeter water recirculation system with sensors in a vacuum filter tank in the gutter overflow line.

Figure 2:
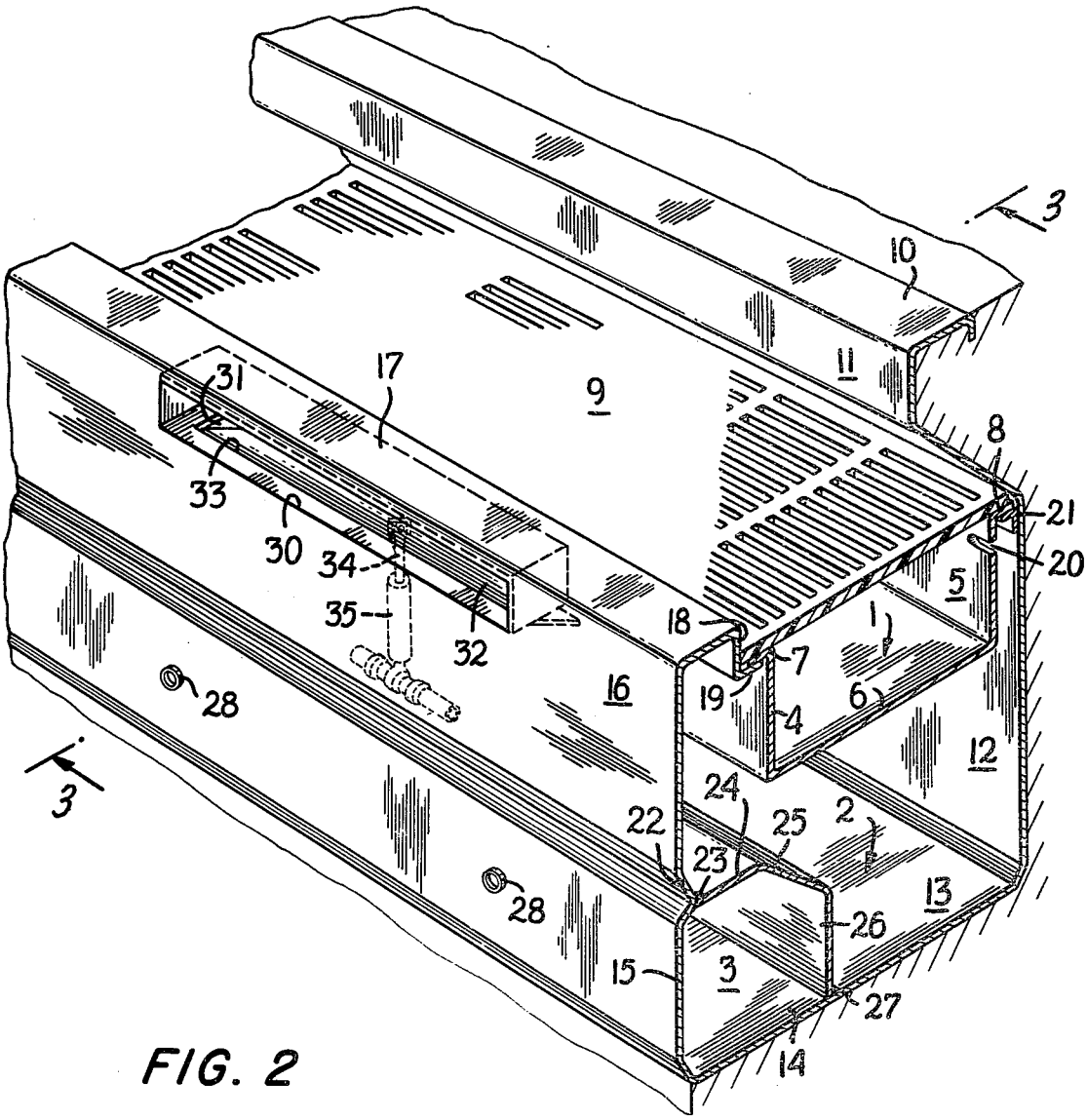
FIG. 2 represents a view of one modular unit of a pool perimeter gutter in accordance with the invention.
Figure 3:
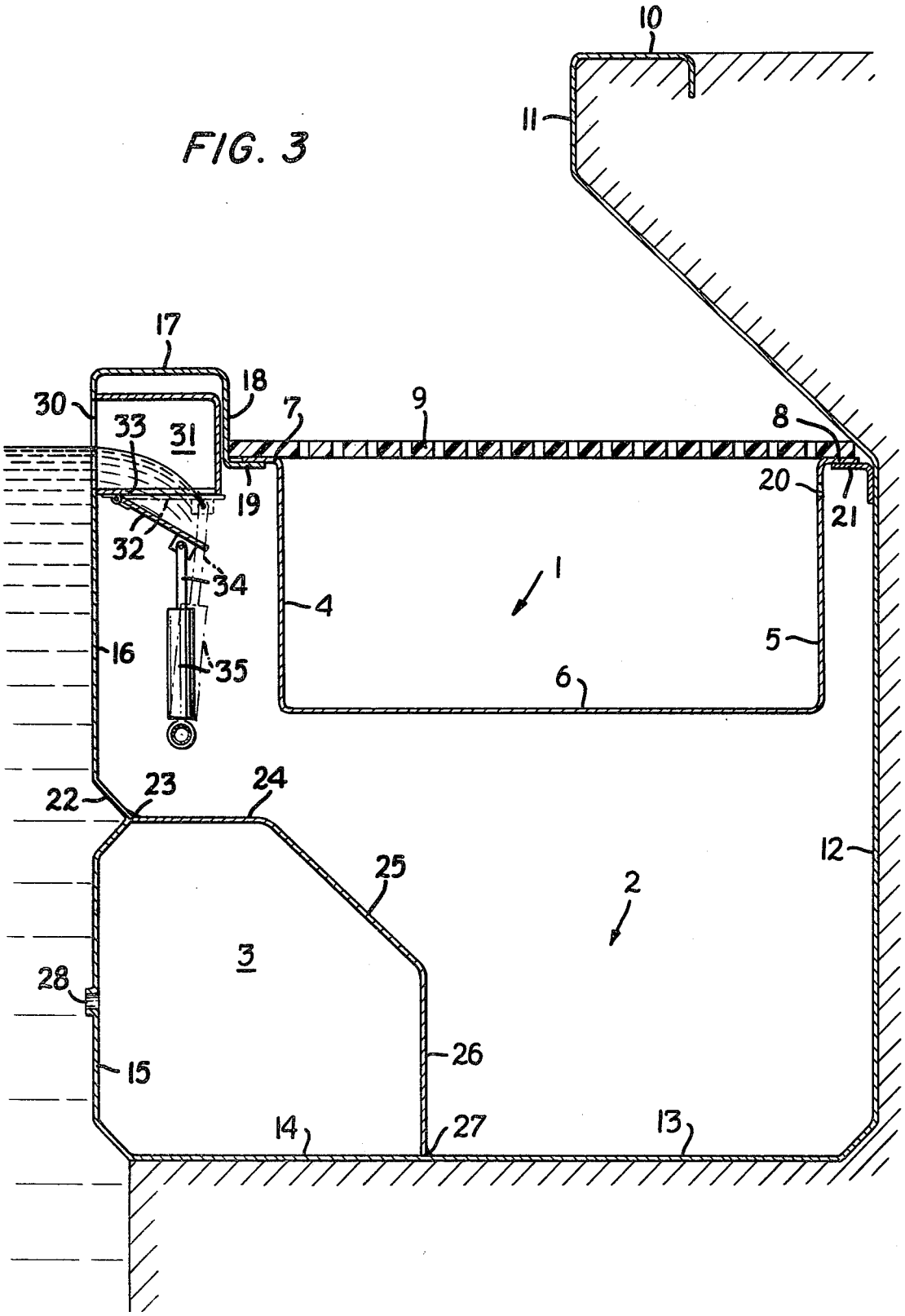
FIG. 3 represents a cross-sectional view through the gutter system shown in FIG. 2, taken along the line 2—2.

The pool perimeter gutter shown in FIGS. 1 to 3 is made in a plurality of modular units, which are fitted together on-site and bonded together by welding, soldering or brazing in the number required to form the perimeter rim of a swimming pool. A sheet of stainless steel or other corrosion-resistant metal or plastic material is formed in the configuration shown, with a top coping 10, a gutter back wall 11, bent forward towards the pool in a manner to partially cover over a first gutter 1, and then continuing to form the back wall 12 and bottom wall 13 of a second gutter 2, the bottom wall 14 and pool perimeter side wall 15 of a water feed conduit 3, the pool perimeter side wall 16 of the second gutter 2, and the top wall 17 of the second gutter 2, which also serves as the top rim of the swimming pool, over which water may flow into the first gutter 1. The stainless steel sheet terminates in a flange 19, which serves as a ledge support for one side of the first gutter 1. A second flange 21 is attached by welding or brazing to the back wall 12 of the second gutter 2, to serve as the other ledge support for the first gutter 1.

The first gutter 1 is made of another sheet of stainless steel, formed in a U-configuration, with sides 4, 5, and bottom 6, terminating in flanges 7, 8 supporting the gutter on flanges 19, 21 of the first sheet. A grille 9 rests on flanges 7, 8, and covers over the open top of the first gutter, so as to prevent bathers from stepping into it, with possibly injurious consequences. The grille of course can be omitted.

In the side wall 5 of the first gutter, there is one or several openings 20 in the form of long narrow slots providing fluid flow communication with the second gutter 2 at the top of the gutter 1. These openings define the maximum water level in the first gutter, since water above this level automatically flows through the openings 20 into the second gutter. The openings are sufficiently numerous and large to accommodate such flow, thus preventing flooding of the first gutter.

Through the pool perimeter side wall 16 of the second gutter are a number of narrow, long openings 30, approximately one-half inch below the top of the top of the gutter. These openings lead to weir passages 31, which accommodate skimming flow from the pool, and feed directly into the second gutter 2. Thus, skimming flow is separated from surge flow across the top 17 of the perimeter gutter, which feeds directly into the first gutter 1. Flaps 32 are provided across the openings 33 at the inner ends of the passages. These flaps on their undersides are pivotally mounted on the pistons 34, which are operated hydraulically in cylinders 35. The flaps can be lowered to the open position, shown in FIGS. 2 and 3, by drawing in the piston, on the suction stroke, or pivoted to the dashed-line position shown in FIG. 2, to close off the weir passages 31, by pushing out the piston, on the power stroke. The opening and closing of the flaps can be effected by any kind of mechanism, however.

The pool perimeter walls 16 of the second gutter 2 and 15 of the water feed conduit 3 meet in a V-notch 22. At the base 23 of the V a third sheet of stainless steel is welded, and formed so as to extend inwardly and down to define the other sidewalls 24, 25, 26 of the water feed conduit 3, and is welded to the bottom 13 of the second gutter conduit 2 at 27.

A plurality of openings 28 are provided in the pool perimeter wall 15 of the water feed conduit 3, for feed of recirculating clean water to the pool. These openings can, if desired, be provided with nozzles or jets, in known manner, directing flow horizontally or downwardly into the pool.

There is a direct line connection 40 leading from the second gutter 2 and the first gutter 1 to the recirculation system 50, and there is also a main drain 41 in the bottom 42 of the swimming pool leading via main drain line 44 to the recirculation system. There is a main drain throttling valve 43 in the main drain line 44, so that this line can be closed off, or partially or fully opened, and there is also a gutter overflow valve 45 in the gutter line 40, so that this can be closed off. On the downstream side of the filter 51 in the water purifying system there is a recirculation flow throttling valve 46, which controls recirculation flow through the return feed line 52 leading to the water feed inlet 53 in the conduit 3. The valve 46 also can be partially or fully opened, or closed, increasing the recirculating flow or decreasing it, as may be required. The pump 54 maintains circulation of water through the filter 51 and return feed line 52 to the conduit 3.

There is also a make-up water valve 47 in fluid flow connection via a line 48 to the fillspout 49 or the deck of the pool, permitting introduction of fresh water from the water supply, such as, for example, the water main supply at the pool location.

The water level sensing system 60, best seen in FIG. 1, is composed of five gutter sensors S1, S2, S3, S4, and S5 of which S1, S2 and S3 are single acting, and the rest double-acting, detecting five different water levels in the second gutter 2, and one single-acting pool sensor S6, detecting water level in the pool. These water levels are sensed not in the second gutter or pool, but in pool level chamber 67 directly connected with the pool, and gutter level chamber 68 directly connected to the second gutter 2. The electric sensors S1, S2, S3, S4, S5 and S6 and the actuating electric control circuit are well known, conventional and commercially available.

Pool level sensed in chamber 67 of the level tank 72 is communicated via the line 69, which is connected with the pool at 70, below the surface of the pool. The pool level tank 72 is so arranged as to reflect a range of pool levels ranging from a level at or below the bottom of the surge weir openings 30 to a level above the top 17 of the pool perimeter gutter.

An electric sensor S6 in the pool level chamber 67 can be adjusted in position on bracket mounting bar 74 so as to sense any desired pool level as water level in the chamber 67, but is normally in a position to sense when the pool is at a predetermined level above the lower rim of openings 30, and is in electric connection with the make-up water valve 47, so as to turn off the make-up water valve when the water level reaches the sensor. Accordingly, the pool sensor S6 cuts off feed of fresh water to the pool when the normal pool operating level, reflected as level N in the gutter 2, has been reached, such as for example, after the pool has been drained and is being refilled, or when the amount of water is diminished for some reason, such as heavy use, and is therefore being replenished.

A gutter level tank 75 is also provided, in fluid flow connection by the line 76 with the second gutter 2, at the bottom. In the chamber 68 of this level tank there are arranged the five gutter sensors, S1, S2, S3, S4, and S5, each responding to a different level of water in the second gutter. The position of these sensors can also be adjusted up or down on bracket mounting bar 77, so that any desired combination of second gutter water levels can be detected, and an appropriate response effected.

The sensor S1 senses and responds to a first level L1 of water in the second gutter 2, corresponding to the minimum pool level, at which the pool water level is below the predetermined skimming flow level above the lower rim of openings 30, and must be replenished. This sensor upon detecting such a low level responds by opening the make-up water valve 47, so that water is admitted from the feed line 55 into the line 48, and thence to the pool at fillspout 49.

The second gutter sensor S2 senses a second and higher water level L2 in the second gutter, corresponding to a level of water in the second gutter above the normal operating level n when the pool is quiescent, with the surge weir passages 31 open, and normal skimming flow provided through the surge weir passages via openings 33 into the second gutter. The sensor responds to this level in the second gutter by opening the surge weirs, sending an electric signal to the piston 34 and cylinder 35 in the second gutter, and actuating the cylinder to withdraw the piston so that the surge weir flaps 32 are opened in the position shown in FIGS. 1, 2, and 3.

The third gutter sensor S3 senses a third and higher gutter water level L3, corresponding to the increased surge weir flow under light pool activity. When the water level reaches L3 because there is too much flow through the weirs, it is necessary to close the surge weirs, to prevent excessive gutter flow. Sensor S3 responds to this condition by actuating the cylinder and pushing out the piston, closing the flaps 32, and closing off the weirs. In this condition, some surge flow cascades over the top 17 of the perimeter gutter into gutter 1, but gutter 1 has adequate capacity to accommodate such flow.

A further increase in pool activity will lead to an increased flow of water across the top 17 of the perimeter gutter into the first gutter 1. Under medium pool activity, the flow fills the gutter 1, whereupon the excess spills over into the second gutter 2, through the passages 20. This increases the water level in the second gutter, to the level L4, sensed by the sensor S4, and increases the burden on the water recirculation system, which requires adjustment to accommodate the increased gutter flow.

Accordingly, this sensor S4 is in actuating connection with the main drain throttling valve 43, and closes the main drain valve, thus making it possible for the recirculation system 50 to accommodate the increased gutter overflow in line 40, the flow through which is now equal to that formerly reaching the recirculation system 50 from the combined volumes of the flows in the main drain line 44 and gutter overflow line 40.

Increased pool activity to the maximum activity level further increases the amount of water cascading across the top 17 of the perimeter gutter into gutter 1, and thence through the overflow openings 20 into gutter 2, with the result that the level in gutter 2 rises to level L5, sensed by the fifth sensor S5. This sensor opens the recirculation flow throttling valve 46, increasing the rate (and therefore the volume amount) of recirculation flow through the recirculation system 50, so as to accommodate the increased flow through the gutters. This is so designed as to accommodate any maximum flow that may be encountered during maximum activity in the pool.

It is apparent that instead of closing the main drain valve 43, an increased recirculation system capacity can be achieved by opening the throttling valve 46. Thus, sensor S4 can be arranged to open valve 46 instead of valve 43.

It is thus apparent that the sensor system in accordance with the invention not only senses and responds to the water level in the pool, but also to water level in the second gutter, so as to respond to activity in the pool at any desired level, as reflected in higher gutter flow, and adjust the water recirculation system to accommodate it without gutter flooding or spill back into the pool.

The necessary gutter capacity to accommodate the increased gutter flow during periods of pool activity, whether low or intense, is provided by the second gutter, thus ensuring that at no time does water washed into the gutter return to the pool without having first passed through the pool cleansing and recirculation system via the filter. The response to three different levels of activity, low, moderate, and high, is fully automatic in all cases.

As pool activity decreases, and gradually returns to normal, the sensors are again actuated in the same order but in reverse sequence, so that the water recirculation system responds to the now decreased circulation through the gutters.

Thus, a decrease in the gutter level below level L5, sensed by sensor S5, results in a throttling back of recirculation flow throttling valve 46. When the level decreases further, to below the level L4, of sensor S4, the main drain throttling valve 43 is again opened. Further decrease to level L2 leads to the actuation via sensor S2 of the piston arrangement to open the flaps 32 and thus reopen the surge weirs, and this condition is maintained as long as the pool is quiescent, at normal pool operating level, i.e., at gutter level N. If for some reason, as for example, through heavy use, the amount of water decreases, so that level L1 is reached, the gutter-sensor S1 opens the make-up valve 47, to restore the pool level to normal, and when the pool level is normal, the pool sensor S6 shuts off the valve 47, thus ensuring adequate skimming flow during periods of quiescence.

The water flow control system is consequently fully automatic, whether the flow to be accommodated is increasing or decreasing, and according to whether the activity in the pool is nil (quiescent), light, medium or heavy.

It will of course be appreciated that different degrees of activity intermediate these can be accommodated, by provision of additional sensors, and additional positions of either the recirculation flow throttling valve, or the gutter overflow and main drain systems.

Figure 4:
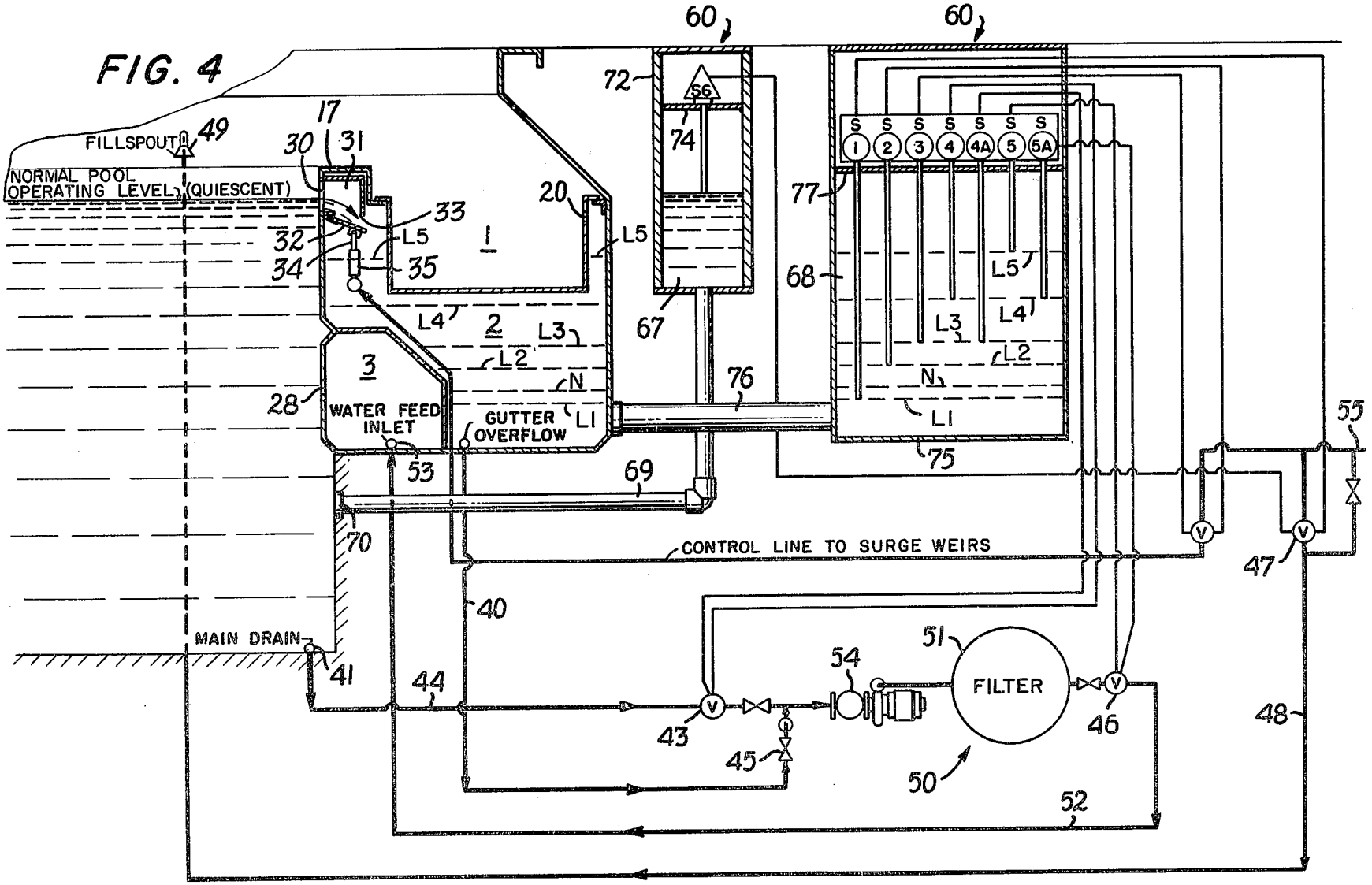
FIG. 4 is a pool water flow circuit diagram, similar to that of FIG. 1, but with two additional sensors for modified intermediate level response.

A modified system is shown in FIG. 4, having eight single-acting sensors instead of two double-acting and four single-acting sensors, with one additional sensor S4*a* controlling opening the main drain throttling valve 43, and one additional sensor S5*a* controlling the closing of the recirculation flow throttlling valve 46, as flow diminishes. In other respects, the system is similar to that of FIG. 1.

The modified water level sensing system 60 of FIG. 4 is composed of seven gutter sensors S1, S2, S3, S4, S4*a*, S5 and S5*a*, detecting five different water levels in the second gutter 2, and one pool sensor, S6, detecting water level in the pool. These water levels are sensed not in the second gutter or pool, but in pool level chamber 67 directly connected with the pool, and gutter level chamber 68 directly connected to the second gutter 2.

Pool level sensed in chamber 67 of the level tank 72 is communicated via the line 69, which is connected with the pool at 70, below the surface of the pool. The pool level tank 72 is so arranged as to reflect a range of pool levels ranging from the level of the bottom of the surge weir openings 30 to a level above the top 17 of the pool perimeter gutter.

An electric sensor S6 in the pool level chamber 67 can be adjusted in position on bracket mounting bar 74 so as to sense any desired level of water in the chamber 67, but is normally in a position to sense when the pool is at the predetermined level above the lower rim of openings 30, and is in electric connection with the make-up water valve 47, so as to turn off the make-up water valve when the water level reaches the sensor. Accordingly, the sensor S6 cuts off feed or fresh water to the pool when the normal pool operating level has been reached, such as, for example, after the pool has been drained and is being refilled, or when the amount of water is for some reason diminished and is therefore being replenished.

A gutter level tank 75 is also provided, in fluid flow connection by the line 76 with the second gutter 2, at the bottom. In the chamber 68 of this level tank there are arranged seven gutter sensors, S1, S2, S3, S4, S4*a*, S5 and S5*a*, responding to five selected different levels of water in the second gutter. The position of these sensors can also be adjusted up or down on bracket mounting bar 77, so that any desired combination of second gutter water levels can be detected, and an appropriate response effected.

The first gutter sensor S1 senses and responds to a first level L1 of water in the second gutter 2 corresponding to the predetermined minimum level at which the pool water level is below skimming flow level at the lower rim of openings 30, and must be replenished. This sensor upon detecting such a low level responds by opening the make-up water valve 47, so that water is admitted from the feed line 55 into the line 48, and thence to the pool at fillspout 49.

The second gutter sensor S2 senses a second and higher water level L2 in the second gutter, corresponding to a level of water in the second gutter above the normal operating level represented by gutter level N, the pool quiescent, the surge weir passages 31 open, and normal skimming flow provided through the surge weir passages via openings 33 into the second gutter. The sensor responds to this level in the second gutter by opening the surge weirs, sending an electric signal to the piston 34 and cylinder 35 in the second gutter, and actuating the cylinder to withdraw the piston so that the surge weir flaps 32 are opened in the position shown in the Figures.

The third gutter sensor S3 senses a third and higher gutter water level L3, corresponding to the increased surge weir flow under light pool activity. When the water level reaches level L3, there is too much flow through the weirs, and it is necessary to close the surge weirs, to prevent excessive gutter flow. Sensor S3 responds to this condition by actuating the cylinder and pushing out the piston, closing the flaps 32, and closing off the weirs.

In this condition, some surge flow cascades over the top 17 of the perimeter gutter into gutter 1, but gutter 1 has adequate capacity to accommodate such flow.

A further increase in pool activity will lead to an increased flow of water across the top 17 of the perimeter gutter into the first gutter 1. Under medium pool activity, the flow fills the gutter 1, whereupon the excess spills over into the second gutter 2, through the passages 20. This increases the water level in the second gutter, to the level L4, sensed by the fourth gutter sensor S4, and increases the burden on the water recirculation system, which requires adjustment to accommodate the increased gutter flow.

Accordingly, this sensor S4 is in actuating connection with the main drain throttling valve 43, and closes the main drain valve, thus making it possible for the recirculation system 50 to accommodate the increased gutter overflow in line 40, the flow through which is now equal to that formerly reaching the recirculation system 50 from the combined volumes of the flows in the main drain line 44 and gutter overflow line 40.

Increased pool activity to the maximum activity level further increases the amount of water cascading across the top 17 of the perimeter gutter into gutter 1, and thence through the overflow openings 20 into the gutter 2, with the result that the level in gutter 2 rises to level L5, sensed by the fifth gutter sensor S5. This sensor opens the recirculation flow throttling valve 46, to the next higher open position, further increasing the rate (and therefore the volume amount) of recirculation flow through the recirculation system 50, so as to accommodate the increased flow through the gutters. This is so designed as to accommodate any maximum flow that may be encountered during maximum activity in the pool.

As pool activity decreases, and gradually returns to normal, the sixth and seventh sensors S5*a* and S4*a* are actuated, in reverse sequence, so that the water recirculation system responds to the now decreased circulation through the gutters.

Thus, a decrease in the gutter level from I5 to L4 is sensed by sensor S5*a*, which thereupon throttles back recirculation flow throttling valve 46 to accommodate normal flow. When the gutter level decreases further, to the level L3, sensor S4*a* is actuated, and opens the main drain throttling valve 43. Further decrease to level L2 leads to the actuation via sensor S2 of the piston arrangement to open the flaps 32, and thus reopen the surge weirs, and this condition is maintained so long as the pool is quiescent, at normal pool operating level, reflected in gutter level N. If for some reason, as for example, through evaporation, the amount of water decreases, so that level L1 is reached, the sensor S1 opens the make-up valve 47, to restore the pool level to normal, whereupon sensor S6 shuts off the valve 47, thus ensuring adequate skimming flow during periods of quiescence.

Figure 5:
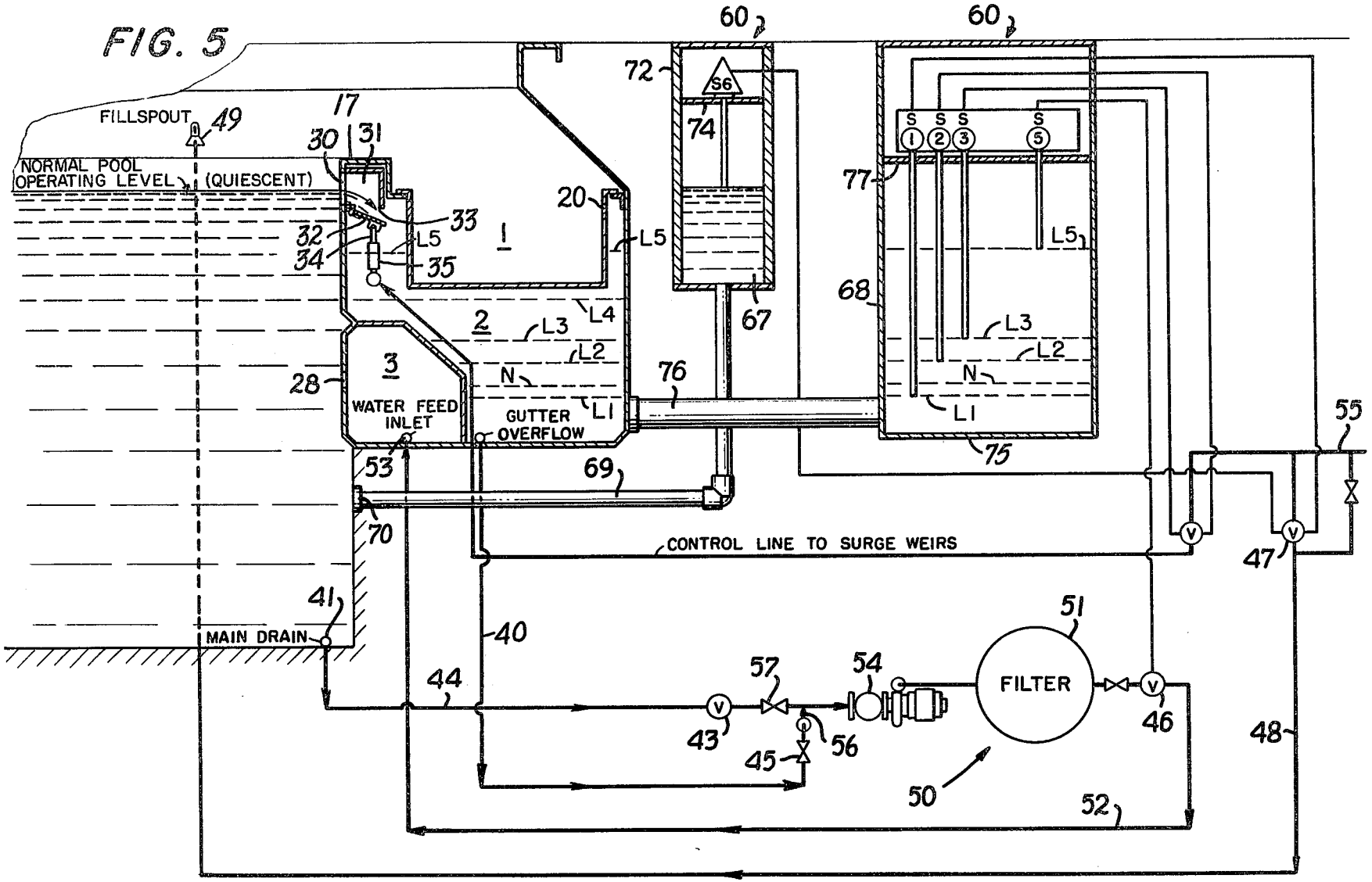
FIG. 5 is a pool water flow circuit diagram similar to that of FIG. 1, but with a balance line substituted for sensor S4.

Another modified system is shown in FIG. 5, having five sensors instead of six, the sensor S4 controlling the main drain throttling valve 43 being replaced by a balance line (or balance tank). In other respects, the system is similar to that of FIG. 1.

The water level sensing system 60 of FIG. 5 is composed of four gutter sensors, S1, S2, S3, and S5, detecting four different water levels in the second gutter 2, and one pool sensor, S6, detecting water level in the pool. These water levels are sensed not in the second gutter or pool, but in pool level chamber 67 directly connected with the pool, and gutter level chamber 68 directly connected to the second gutter 2.

Pool level sensed in chamber 67 of the level tank 72 is communicated via the line 69, which is connected with the pool at 70, below the surface of the pool. The pool level tank 72 is so arranged as to reflect a range of pool levels ranging from the level of the bottom of the surge weir openings 30 to a level above the top 17 of the pool perimeter gutter.

An electric pool level sensor S6 in the pool level chamber 67 can be adjusted in position on bracket mounting bar 74 so as to sense any desired level of water in the chamber 67, but is normally in a position to sense when the pool is at the lower rim of openings 30, and is in electric connection with the make-up water valve 47, so as to turn off the make-up water valve when the water level reaches the sensor. Accordingly, the sensor S6 cuts off feed of fresh water to the pool when the normal pool operating lever has been reached, such as, for example, after the pool has been drained and is being refilled, or when the amount of water is for some reason diminished and is therefore being replenished.

A gutter level tank 75 is also provided, in fluid flow connection by the line 76 with the second gutter 2, at the bottom. In the chamber 68 of this level tank there are arranged four gutter sensors, S1, S2, S3 and S5, each responding to a different level of water in the second gutter. The position of these sensors can also be adjusted up or down on bracket mounting bar 77 so that any desired combination of second gutter water levels can be detected, and an appropriate response effected.

The first gutter sensor S1 senses and responds to a first level L1 of water in the second gutter 2 corresponding to the predetermined minimum level, at which the pool water level is below skimming flow level at the lower rim of openings 30, and must be replenished. This sensor upon detecting such a low level responds by opening the make-up water valve 47, so that water is admitted from the feed line 55 into the line 48, and thence to the pool at fillspout 49.

The second gutter sensor S2 senses a second and higher water level L2 in the second gutter, corresponding to the level of water in the second gutter above the normal operating level reflected in gutter level N, when the pool is quiescent, with the surge weir passages 31 open, and normal skimming flow provided through the surge weir passages via openings 33 into the second gutter. The sensor responds to this level in the second gutter by opening the surge weirs, sending an electric signal to the piston 34 and cylinder 35 in the second gutter, and actuating the cylinder to withdraw the piston so that the surge weir flaps 32 are opened in the position shown in the Figure.

The third gutter sensor S3 senses a third and higher gutter water level L3, corresponding to the increased surge weir flow under light pool activity. When the water level reaches L3, there is too much flow through the weirs, and it is necessary to close the surge weirs, to prevent excessive gutter flow. Sensor S3 responds to this condition by actuating the cylinder and pushing out the piston, closing the flaps 32, and closing off the weirs. In this condition, some surge flow cascades over the top of 17 of the perimeter gutter into gutter 1, but gutter 1 has adequate capacity to accommodate such flow.

A further increase in pool activity will lead to an increased flow of water across the top 17 of the perimeter gutter into the first gutter 1. Under medium pool activity, the flow fills the gutter 1, whereupon the excess spills over into the second gutter 2, through the passages 20. This increases the water flow in the second gutter, and in the gutter overflow return line 40, to the level L4.

However, the balance between the main drain line 44 and the gutter overflow line 40 is now weighted in favor of the gutter overflow line 40, so that the water recirculation system 50 draws the bulk of the flow from the gutter. This is done in known manner.

The main drain line 44 is provided with the main drain throttling control valve 43, and the gutter overflow line 40 is provided with the gutter valve 45. The main drain valve 43 is cut back to the point where, under normal gutter flow conditions, corresponding to activity levels up to and including the light activity level, the pump is starved for fluid from the main drain, and draws on the gutter overflow line 40 for such fluid, to maintain the predetermined recirculating flow. Under the normal gutter flow, a vacuum may in fact be drawn on the balance line 56.

Accordingly, the pool reaches the medium activity level, and an increased water flow occurs in the second gutter, through the passages 20. This flow increases the back pressure in the main drain line 44, and the pump (being already starved for fluid) is readily able to accommodate this additional flow without any increase in the burden on the water recirculation system, and simply draws such flow down from the gutter overflow line 40.

Increased pool activity to the maximum activity level further increases the amount of water cascading across the top 17 of the perimeter gutter into gutter 1, and thence through the overflow openings 20 into the gutter 2, with the result that the level in gutter 2 rises to level L5, sensed by the fifth sensor S5. This sensor opens the recirculation flow throttling valve 46, increasing the rate (and therefore the volume amount) of recirculation flow through the recirculation system 50, so as to accommodate the increased flow through the gutters. This is so designed as to accommodate any maximum flow that may be encountered during maximum activity in the pool.

As pool activity decreases, and gradually returns to normal, the sensors are again actuated in the same order but in reverse sequence, so that the water recirculation system responds to the now decreased circulation through the gutters.

Thus, a decrease in the gutter level from L5, sensed by sensor S5, to L3, sensed by sensor S3, results in a throttling back of recirculation flow throttling valve 46. When the level decreases further, to the level L2, actuation via sensor S2 of the piston arrangement opens the flaps 32 and thus reopens the surge weirs, and this condition is maintained as long as the pool is quiescent, at normal pool operating level, reflected in gutter level N.

If for some reason, as for example, through evaporation, the amount of water decreases, so that level L1 is reached, the sensor S1 opens the make-up valve 47, to restore the pool level to normal, whereupon sensor S6 shuts off the valve 47, thus ensuring adequate skimming flow during periods of quiescence.

The pool level and skimming gutter control system of FIGS. 1 to 5 is a water recirculating system which is controlled automatically by the swimming load. The most desirable of the various possible operating modes is selected automatically by the control system, dynamically guided by the amount of people in the pool, and their activity.

During quiescence (no persons in the pool) surface cleaning takes place through open surge weirs. As swimmers enter the pool causing displacement surge and waves, these weirs will automatically and positively close. As activity continues to increase, the main drain will close requiring all water from the swimming pool to be drawn from the perimeter overflow system channels. As the number of swimmers increases and the activity level increases, the recirculation (turnover) rate will automatically increase, improving the quality of filtration. As the bathers leave the pool, the recirculating rate will return to normal, and the main drain and surge weirs will open at predetermined levels, as the pool returns to its quiescent state. If after reaching quiescence the designed rate of surface cleaning is not being maintained, water will automatically be added to the swimming pool until this rate is achieved.

Functionally, the lower of the two gutters, the second gutter, accepts water through the surge weirs during quiescence, and continues to accept water until it reaches a predetermined level. At this level, the surge weirs automaticaly close, requiring all water to enter the first gutter of the perimeter overflow system by passing over the perimeter overflow system lip into the upper gutter. Water may flow from the upper first gutter directly to the filtration system, or it may pass through surge control ports into the lower second gutter. As the pool activity and number of swimmers decrease, the upper gutter will drain, the system will return to its normal recirculating rate, and the surge weirs will open.

The system thus responds automatically to user-activated dynamic demand, to determine the operating mode, continuously and automatically for the life of the swimming pool:

1. Maintains the water level
2. Sets the proper surface cleaning (skimming) flow rate
3. Senses whether the surge weirs should be open or closed
4. Determines whether the main drain should be partially open or closed
5. Increases the recirculating rate as required due to heavy loading In addition to dynamic sensing of the above, this system can be designed to provide surge containment capacity and flow rates for up to 3000 gallons per minute. If offers completely uniform distribution of clean water to the pool; it provides a safety handhold, and it can be supplied with a grating, if this be thought to be desirable.

Due to the increased recirculation rate under heavy loading, the system has the further advantage of improving the pool surface conditions for competition. The higher gutter flow transfer over the perimeter-rim combined with heavier clean water feed has a wave-quelling effect, reducing turbulence. If the clean water feed is directed downwardly, there is created an upflow in the central portion of the pool, drawn off at the perimeter, further reducing wave rebound at the perimeter.

Figure 6:
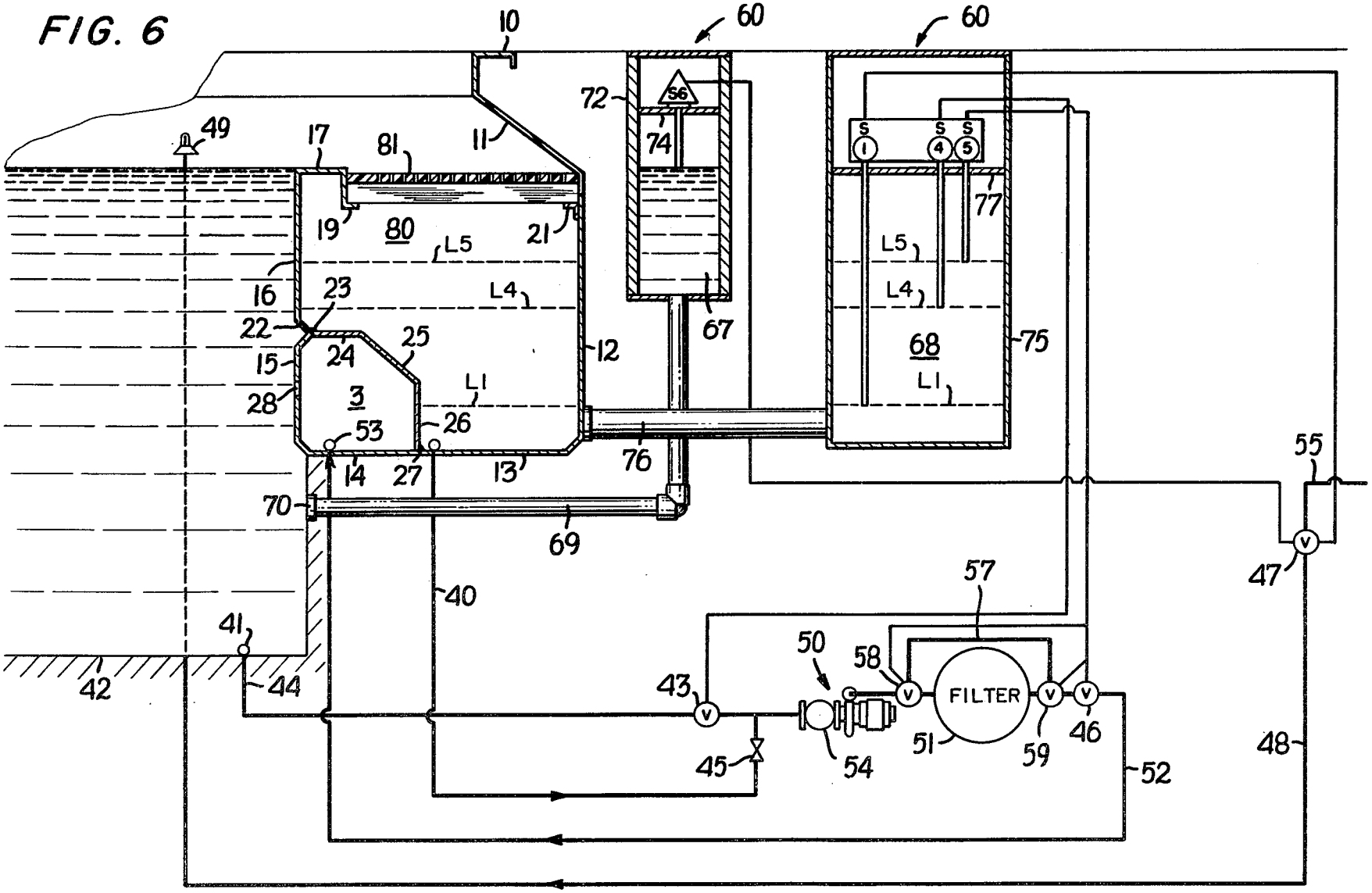
FIG. 6 is a pool water flow circuit diagram, showing a single-gutter pool perimeter water recirculation system with the automated control system of the invention imposed thereon.
Figure 7:
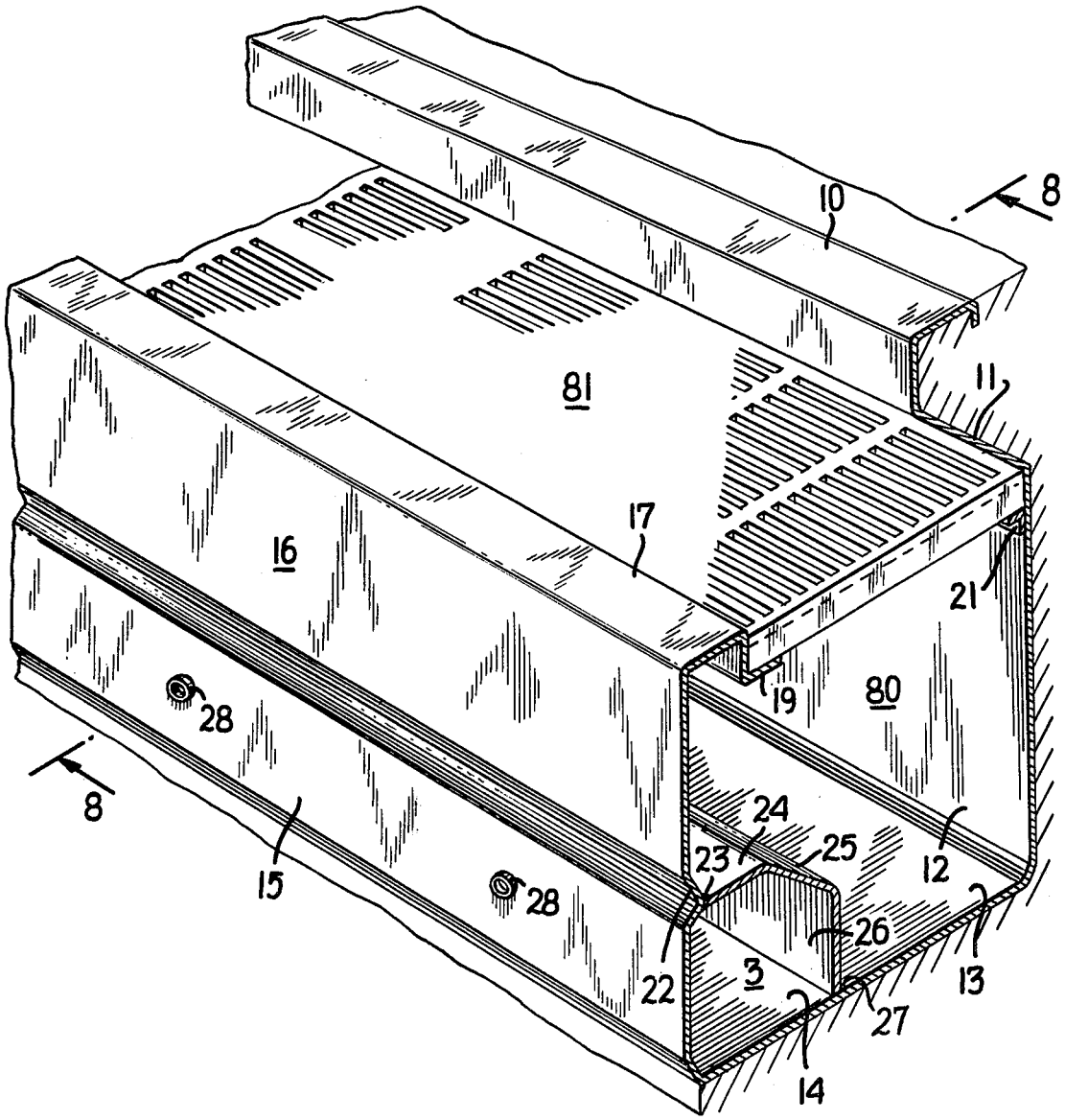
FIG. 7 represents a view of one modular unit of a single-gutter pool perimeter gutter in accordance with the invention.
Figure 8:
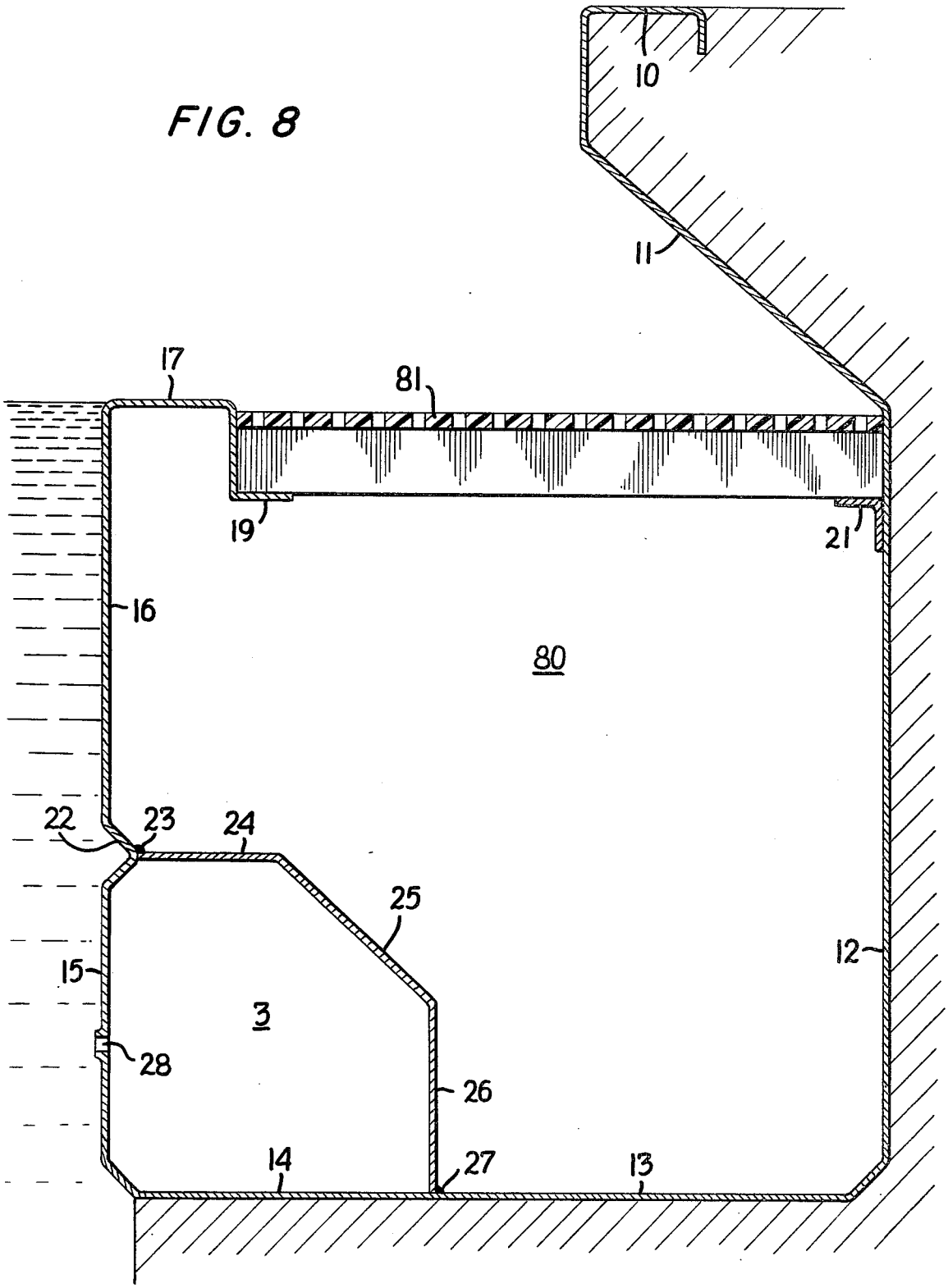
FIG. 8 represents a cross-sectional view through the gutter system shown in FIG. 7, taken along the line 8—8.

The large capacity single-gutter pool perimeter gutter shown in FIGS. 6 to 8 is made in a plurality of modular units, which are fitted together on-site and bonded together by welding, soldering or brazing in the number required to form the perimeter rim of a swimming pool. A sheet of stainless steel or other corrosion-resistant metal or plastic material is formed in the configuraion shown, with a top coping 10, a gutter back wall 11, bent forward towards the pool in a manner to partially cover over the gutter 80, and then continuing to form the back wall 12 and bottom wall 13 of the gutter 80, the bottom wall 14 and pool perimeter side wall 15 of a water feed conduit 3, the pool perimeter side wall 16 of the gutter 80, and the top wall 17 of the gutter 80, which also serves as the top rim of the swimming pool, over which water may flow into the gutter 80. The stainlesssteel sheet terminates in a flange 19, which serves as a ledge support for one side of the grating 81 over the gutter 80. A second flange 21 is attached by welding or brazing to the back wall 12 of the gutter 80, to serve as the other ledge support for the grating 81. The grating 81 is not essential, and can be omitted. The grating covers over the open top of the gutter, so as to prevent bathers from stepping into it, with possibly injurious consequences.

The top wall 17 of the gutter defines the maximum water level in the pool, and serves as a skimming weir, since water above this level automatically flows over the top 17, through the grating 81 into the gutter 80. The gutter 80 is of a large enough capacity to accommodate all such flow, without flooding.

The pool perimeter walls 16 of the gutter 80 and 15 of the water feed conduit 3 meet in a V-notch 22. At the base 23 of the V a second sheet of stainless steel is welded, and formed so as to extend inwardly and down to define the other sidewalls 24, 25, 26 of the water feed conduit 3, and is welded to the bottom 13 of the gutter conduit 80 at 27.

A plurality of openings 28 are provided in the pool perimeter wall 15 of the water feed conduit 3, for feed of recirculating clean water to the pool. These openings can, if desired, be provided with nozzles or jets, in known manner, directing water flow horizontally or downwardly into the pool.

There is a direct line connection 40 leading from the gutter 80 to the recirculation system 50, and there is also a main drain 41 in the bottom 42 of the swimming pool, leading via the main drain line 44 to the recirculation system. There is a main drain throttling valve 43 in the main drain line 44, so that this line can be closed off, or partially or fully opened, and there is also a gutter valve 45 in the gutter line 40, so that this can be closed off. On the downstream side of the filter 51 in the water purifying system there is a recirculation flow throttling valve 46, which controls recirculation flow through the return feed line 52 leading to the water feed inlet 53 in the conduit 3. The valve 46 also can be partially or fully opened, or closed, increasing the recirculating flow or decreasing it, as may be required. The pump 54 maintains circulation of water through the filter 51 and return feed line 52 to the conduit 3.

There is also a make-up water valve 47 in fluid flow connection via a line 48 to the fillspout 49 on the deck of the pool, permitting introduction of fresh water from the water supply, such as, for example, the water main supply at the pool location.

The water level sensing system 60, best seen in FIG. 6, is composed of three gutter sensors S1, S4, S5, detecting three different water levels in the gutter 80, and one pool sensor S6, detecting water level in the pool. These water levels are sensed not in the gutter or pool, but in pool level chamber 67 directly connected with the pool, and gutter level chamber 68 directly connected to the gutter 80.

Pool level sensed in chamber 67 of the level tank 72 is communicated via the line 69, which is connected with the pool at 70, below the surface of the pool. The pool level tank 72 is so arranged as to reflect a range of pool levels ranging from a level below to a level above the top 17 of the pool perimeter gutter.

An electric pool sensor S6 in the pool level chamber 67 can be adjusted in position on bracket mounting bar 74 so as to sense any desired level of water in the chamber 67, but is normally in a position to sense when the pool is at a predetermined level above the top 17, and is in electric connection with the make-up water valve 47, so as to turn off the make-up water valve when the water level in chamber 67 (and the pool) reaches the sensor. Accordingly, the sensor S6 cuts off feed of fresh water to the pool when the normal pool operating level has been reached, such as for example, after the pool has been drained and is being refilled, or when the amount of water is diminished for some reason such as heavy use, and is therefore being replenished.

A gutter level tank 75 is also provided, in fluid flow connection by the line 76 with the gutter 80, at the bottom. In the chamber 68 of this level tank there are arranged three double-acting sensors S1, S4, and S5, each responding to a different level of water in the gutter. The position of these sensors can also be adjusted up or down on bracket mounting bar 77, so that any desired combination of gutter water levels can be detected, and an appropriate response effected.

The sensor S1 senses and responds to a first level L1 of water in the gutter 80 corresponding to the minimum pool level, at which the pool water level is below the predetermined skimming flow level above the top 17 of the gutter 80, and must be replenished. This sensor upon detecting such a low level response by opening the make-up water valve 47, so that water is admitted from the feed line 55 into the line 48, and thence to the top of the pool at fillspout 49.

An increase in pool activity will lead to an increased flow of water across the top 17 of the perimeter gutter into the gutter 80. Under medium pool activity, the flow increases the water level in the gutter 80 to above the normal operating level N to the level L4, sensed by the gutter sensor S4, and increases the burden on the water recirculation system, which requires adjustment to accommodate the increased gutter flow.

Accordingly, this sensor S4 is in actuating connection with the main drain throttling valve 43, and closes the main drain valve, thus making it possible for the recirculation system 50 to accommodate the increased gutter overflow in line 40, the flow through which is now equal to that formerly reaching the recirculation system 50 from the combined volumes of the flows in the main drain line 44 and gutter overflow line 40.

Increased pool activity to the maximum activity level further increases the amount of water cascading across the top 17 of the perimeter gutter into the gutter 80, with the result that the level in the gutter rises still higher, to level L5, sensed by the gutter sensor S5. This sensor thereupon opens the valves 58, 59, permitting flow in line 57, bypassing the filter 51, and this sensor opens the recirculation flow throttling valve 46, increasing the rate (and therefore the volume amount) of recirculation flow through the recirculation system 50, so as to accommodate the increased flow through the gutter. This is so designed as to accommodate any maximum gutter flow that may be encountered during maximum activity in the pool.

As pool activity decreases, and gradually returns to normal, the sensors are again actuated, in the same order but in reverse sequence, so that the water recirculation system responds to the now decreased circulation through the gutters.

Thus a decrease in the gutter level to below level L5, sensed by sensor S5 results in closing valves 58, 59 and thus bypass line 57 and a throttling back of recirculation flow throttling valve 46. When the level decreases further, to below level L4, sensed by sensor S4, the main drain throttling valve 43 is again opened. This condition is maintained so long as the pool is quiescent, and at normal pool operating level, reflected in gutter level N. If for some reason, as for example, through heavy use, the amount of water decreases, so that level L1 is reached, the sensor S1 opens the make-up valve 47, to restore the pool level to normal skimming flow level, whereupon pool sensor S6 shuts off the valve 47, thus ensuring adequate skimming flow during periods of quiescence.

The water flow control system is consequently fully automatic, whether the flow to be accommodated is increasing or decreasing, and according to whether the activity in the pool is nil (quiescent), light, medium or heavy.

It will of course be appreciated that different degrees of activity intermediate these can be accommodated, by provision of additional sensors, as in FIGS. 1 to 5, and additional positions of either the recirculation flow throttling valve, or the gutter overflow and main drain systems.

Figure 9:
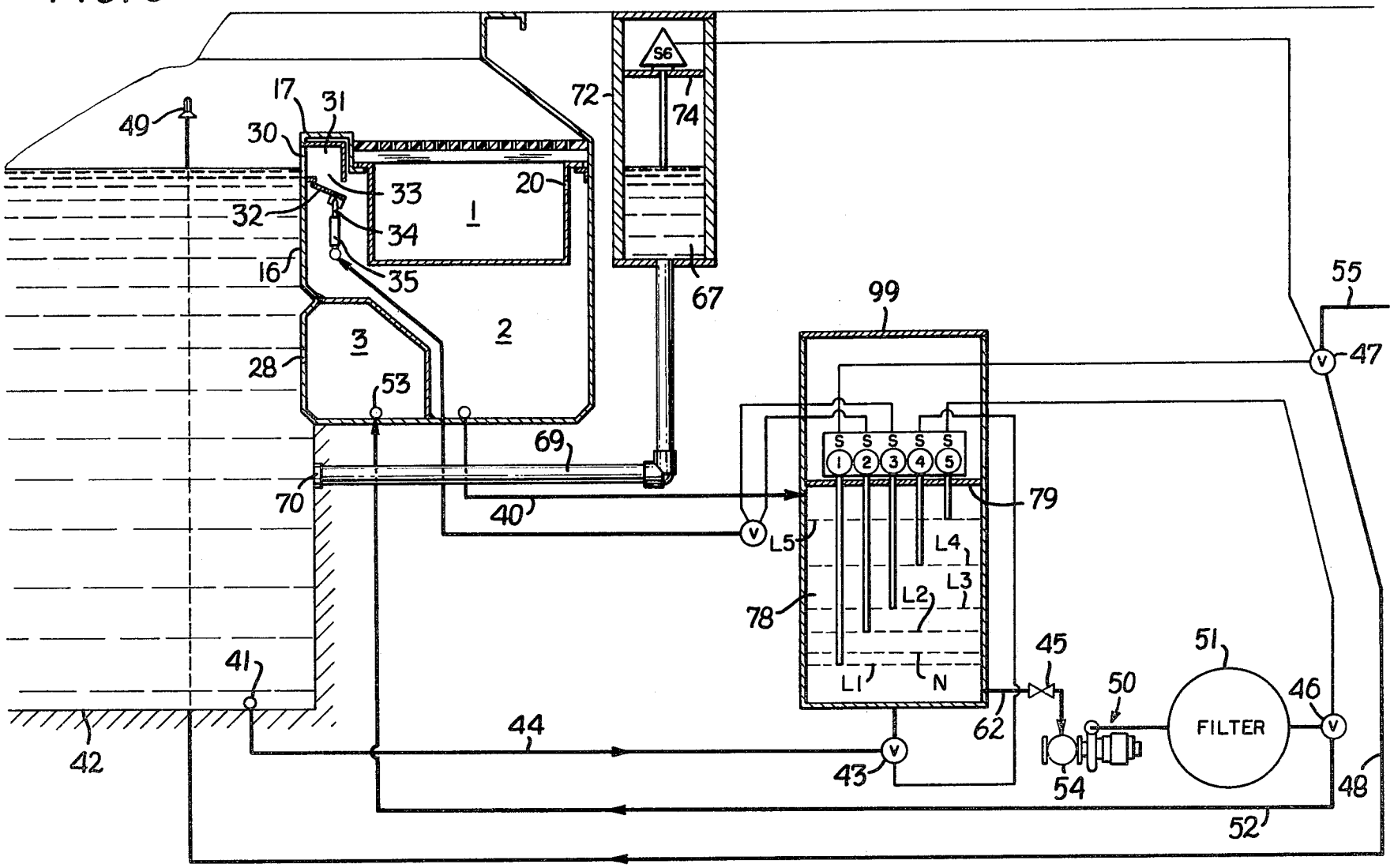
FIG. 9 is a pool water flow circuit diagram, showing a double-gutter pool perimeter water recirculation system with sensors in a balance tank in the gutter overflow line.

A further modification of the water flow circulation layout for the pool perimeter gutter system shown in FIGS. 1 to 3 is shown in FIG. 9. In this case, the gutter level tank 75 is replaced by a balance tank 99 in the gutter overflow line 40. A vacuum filter tank can be substituted for the balance tank 99, in the same location, before, the pump, with the sensors in the filter bed, and the filter 51 omitted.

Consequently, there are five sensors instead of six, the sensor S4 controlling the main drain throttling valve 43 being replaced by the balance tank 99. In other respects, the recirculation system is similar to that of FIG. 1.

There is a direct line connection 40 leading from the second gutter 2 and the first gutter 1 into the top of the balance tank 99, and then via line 59 to the recirculation system 50, and there is also a main drain 41 in the bottom 42 of the swimming pool leading via main drain line 44 to the bottom of tank 99. There is a main drain throttling valve 43 in the main drain line 44, so that this line can be closed off, or partially or fully opened, and there is also a valve 45 in the balance tank line 62, so that this can be closed off. On the downstream side of filter 51 in the water purifying system there is a recirculation flow throttling valve 46, which controls recirculation flow through the return feed line 52 leading to the water feed inlet 53 in the conduit 3. The valve 46 also can be partially or fully opened, or closed, increasing the recirculation flow or decreasing it, as may be required. The pump 54 maintains circulation of water through the filter 51 and return feed line 52 to the conduit 3.

There is also a make-up water valve 47 in fluid flow connection via a line 48 to the fillspout 49 or the deck of the pool, permitting introduction of fresh water from the water supply, such as, for example, the water main supply at the pool location.

The water level sensing system of FIG. 9 is disposed in the balance tank 99, and is composed of five sensors S1, S2, S3, S4, and S5, detecting four different water levels in the balance tank, and one pool sensor S6, detecting water level in the pool. The pool water level is sensed in pool level chamber 67, directly conneced with the pool, while the balance tank level is directly correlated with water flow in the first and second gutters.

Pool level sensed in chamber 67 of the level tank 72 is communicated via the line 69, which is connected with the pool at 70, below the surface of the pool. The pool level tank 72 is so arranged as to reflect a range of pool levels ranging from the level of the bottom of the surge weir openings 30 to a level above the top 17 of the pool perimeter gutter.

An electric pool level sensor S6 in the pool level chamber 67 be adjusted in position on bracket mounting bar 74 so as to sense any desired level of water in the chamber 67, but is normally in a position to sense when the pool is at the lower rim of openings 30, and is in electric connection with the make-up water valve 47, so as to turn off the make-up water valve when the water level reaches the sensor. Accordingly, the sensor S6 cuts off feed or fresh water to the pool when the normal pool operating level has been reached, such as, for example, after the pool has been drained and is being refilled, or when the amount of water is for some reason diminished and is therefore being replenished.

In the chamber 78 of the balance tank 99 there are arranged five sensors, S1,S2,S3,S4 and S5, each responding to a different level of water in the tank. The position of these sensors can also be adjusted up or down on bracket mounting bar 79, so that any desired combination of water levels can be detected, and an appropriate response effected.

The first sensor S1 senses and responds to a first level L1 of water in tank 99 corresponding to the predetermined minimum pool water level at which the pool water level is below skimming flow level at the lower rim of openings 30, and must be replenished. This sensor upon detecting such a low level responds by opening the make-up water valve 47, so that water is admitted from the feed line 55 into the line 48, and thence to the pool at fillspout 49.

The second sensor S2 senses a second and higher water level L2 in the tank 99, above the normal operating pool water level, reflected in gutter level N, with the pool quiescent, with the surge weir passages 31 open, and normal skimming flow provided through the surge weir passages via openings 33 into the second gutter. The sensor responds to this level in the tank 99 by opening the surge weirs, sending an electric signal to the piston 34 and cylinder 35 in the second gutter, and actuating the cylinder to withdraw the piston, so that the surge weir flaps 32 are opened, in the position shown in the FIGURE The third sensor S3 senses a third and higher water level L3 in the tank 99, corresposning to the increased surge weir flow into the gutter under light pool activity. When the water level reaches L3, there is too much flow through the weirs, and it is necessary to close the surge weirs, to prevent excessive gutter flow. Sensor S3 responds to this condition by actuating the cylinder and pushing out the piston, closing the flaps 32, and closing off the weirs, In this condition, some surge flow cascades over the top of 17 of the perimeter gutter into gutter 1, but gutter 1 has adequate capacity to accommodate such flow.

A further increase in pool activity will lead to an increased flow of water across the top 17 of the perimeter gutter into the first gutter 1. Under medium pool activity, the flow fills the gutter 1, whereupon the excess spills over into the second gutter 2, through the passages 20. This increases the water flow in the second gutter, and in the gutter overflow return line 40, bringing the water level in the balance tank 99 to the level L4, sensed by the gutter sensor S4, and increases the burden on the water recirculation system, which requires adjustment to accommodate the increased gutter flow.

Accordingly, this sensor S4 is in actuating connection with the main drain throttling valve 43, and closes the main drain valve, thus making it possible for the recirculation system 50 to accommodate the increased gutter oveflow in line 40, the flow through which is now equal to that formerly reaching the balance tank 99 and recirculating system 50 from the combined volumes of the flows in the main drain line 44 and gutter overflow line 40.

Increased pool activity to the maximum activity level further increases the amount of water cascading across the top 17 of the perimeter gutter into gutter 1, and thence through the overflow openings 20 into the gutter 2, with the result that the level in tank 99 rises to level L5, sensed by the fifth sensor S5. This sensor opens the recirculation flow throttling valve 46, increasing the rate (and therefore the volume amount) of recirculation flow through the recirculation system 50, so as to accommodate the increased flow through the gutters. This is so designed as to accommodate any maximum flow that may be encountered during maximum activity in the pool.

As the pool activity decreaes, and gradually returns to normal, the sensors are again actuated in the same order but in reverse sequence, so that the water recirculation system responds to the now decreased circulation through the gutters.

Thus, a decrease in the water level below level L5, sensed by sensor S5, results in a throttling back of recirculation flow throttling valve 46. When the level decreases further, to below level L4, of sensor S4, the main drain throttling valve 43 is again opened. Further decrease to level L2 leads to the actuation via sensor S2 of the piston arrangement to open the flaps 32 and thus reopen the surge weirs, and this condition is maintained as long as the pool is quiesecent, at normal pool operating level. If for some reason, as for example, through evaportion, the amount of water decreaes, so that level L1 is reached the sensor S1 opens the make-up valve 47, to restore the pool level to normal, whereupon sensor S6 shuts off the valve 47, thus ensuring adequate skimming flow during periods of quiescence.

The pool level and balance tank control system of FIG. 9, like that of FIGS. 1 to 5, is a water recirculating system which is controlled automatically by the swimming load. The most desirable of the various possible operating modes is selected automatically by the control system, dynamically guided by the amount of people in the pools and their activity.

During quiescence (no persons in the pool) surface cleaning takes place through open surge weirs. As swimmers enter the pool causing displaement surge and waves, these weirs will automatically and positively close. As activity continues to increases the main drain will close requiring all water from the swimming pool to be drawn from the perimeter overflow system channels. As the number of swimmers increases and the activity level increases, the recirculation (turnover) rate will automatically increase, improving the quality of filtration. As the bathers leave the pool, the recirculating rate will return to normal, and the main drain and surge weirs will open at predetermined levels, as the pool returns to its quiescent state. If after reaching quiesence the designed rate of surface cleaning is not being maintained, water will automatically be added to the swimming pool until this rate is achieved.

Functionally, the lower of the two gutters, the second gutter, accepts water through the surge weirs during quiesence, and continues to accept water until it reaches a predetermined level. At this level, the surge weirs automatically close, requiring all water to enter the first gutter of the perimeter overflow system by passing over the perimeter overflow system lip into the upper gutter. Water may flow from the upper first gutter directly to the filtration system, or it may pass through surge control ports into the lower second gutter. As the pool activity and number of swimmers decrease, the upper gutter will drain, the system will return it its normal recirculating rate, and the surge weirs will open.

The system thus responds automatically to user-activated dynamic demand, to determine the operating mode, continuously and automatically for the life of the swimming pool.

The water flow control system is consequently fully automatic, whether the flow to be accommodated is increasing or decreasing, and according to whether the activity in the pool is nil (quiescent), light, medium or heavy The pool perimeter gutter shown in FIG. 10 is similar to that of FIG. 1, except for the interchanging of the function of sensors S1 and S6, and therefore like reference numerals are used for like parts.

A sheet of stainless steel or other corrosion-resistance metal or plastic material is formed in the configuration shown, with a top coping 10, a gutter back wall 11, bent forward towards the pool in a manner to partially cover over a first gutter 1, and then continuing to form the back wall 12 and bottom wall 13 of a second gutter 2, the bottom wall 14 and pool perimeter side wall 15 of a water feed conduit 3, the pool perimeter side wall 16 of the second gutter 2, and the top wall 17 of the second gutter 2, which also serves as the top rim of the swimming pool, over which water may flow into the first gutter 1. The stainless steel sheet terminates in a flange 19, which serves as a ledge support for one side of the first gutter 1. A second flange 21 is attached by welding or brazing to the back wall 12 of the second gutter 2, to serve as the other ledge support for the first gutter 1.

The first gutter 1 is made of another sheet of stainless steel, formed in a U-configuration, with sides 4,5, and bottom 6, terminating in flanges 7,8 supporting the gutter on flanges 19,21 of the first sheet. A grille 9 rests on flanges 7,8, and covers over the open top of the first gutter, so as to prevent bathers from stepping into it, with possibly injurious consequences. The grille of course can be omitted.

In the side wall 5 of the first gutter, there is one or several openings 20 in the form of long narrow slots providing fluid flow communication with the second gutter 2 at the top of the gutter 1. These openings define the maximum water level in the first gutter, since water above this level automatically flows through the openings 20 into the second gutter. The openings are sufficiently numerous and large to accommodate such flow, thus preventing flooding of the first gutter.

Through the pool perimeter side wall 16 of e second gutter are a number of narrow, long openings 30, approximately one-half inch below the top of the top of the gutter. These openings lead to weir passages 31, which accommodate skimming flow from the pool, and feed directly into the second gutter 2. Thus, skimming flow is separated from surge flow across the top 17 of the perimeter gutter, which feeds directly into the first gutter 1. Flaps 32 are provided across the openings 33 at the inner ends of the passages. These flaps on their undersides are pivotally mounted on the pistons 34, which are operated hydraulically in cylinders 35. The flaps can be lowered to the open position (as shown in FIGS. 2 and 3) by drawing in the piston, on the suction stroke, or pivoted to the dashed-line position shown in FIG. 2, to close off the weir passages 31, by pushing out the piston, on the power stroke. The opening and closing of the flaps can be effected by any kind of mechanism, however.

The pool perimeter walls 16 of the second gutter 2 and 15 of the water feed conduit 3 meet in a V-notch 22. At the base 23 of the V a third sheet of stainless steel is welded, and formed so as to extend inwardly and down to define the other sidewalls 24,25,26 of the water feed conduit 3, and is welded to the bottom 13 of the second gutter conduit 2 at 27.

A plurality of openings 28 are provided in the pool perimeter wall 15 of the water feed conduit 3, for feed of recirculating clean water to the pool. These openings can, if desired, be provided with nozzles or jets, in known manner, directing flow horizontally or downwardly into the pool.

There is a direct line connection 40 leading from the second gutter 2 and the first gutter 1 to the recirculation system 50, and there is also a main drain 41 in the bottom 42 of the swimming pool leading via main drain line 44 to the recirculation system. There is a main drain throttling valve 43 in the main drain line 44, so that this line can be closed off, or partially or fully opened, and there is also a gutter overflow valve 45 in the gutter line 40, so that this can be closed off. On the downstream side of the filter 51 in the water purifying system there is a recirculation flow throttling valve 46, which controls recirculation flow through the return feed line 52 leading to the water feed inlet 53 in the conduit 3. The valve 46 also can be partially or fully opened, or closed, increasing the recirculating flow or decreasing it, as may be required. The pump 54 maintains circulation of water through the filter 51 and return feed line 52 to the conduit 3.

There is also a make-up valve 47 in fluid flow connection via a line 48 to the fillspout 49 or the deck of the pool, permitting introduction of fresh water from the water supply, such as, for example, the water main supply at the pool location.

The water level sensing system 60, best seen in FIG. 10, is composed of five gutter sensors S1, S2, S3, S4, and S5 of which S1, S2 and S3 are single acting, and the rest double-acting, detecting five different water levels in the second gutter 2, and one single-acting pool sensor S6, detecting water level in the pool. These water levels are sensed not in the second gutter or pool, but in pool level chamber 67 directly connected with the pool, and gutter level chamber 68 connected to the second gutter 2. The electric sensors S1, S2, S3, S4, S5 and S6 and the actuating electric control circuit are well known, conventional and commercially available.

Pool level sensed in chamber 67 of the level tank 72 is communicated via the line 69, which is connected with the pool at 70, below the surface of the pool. The pool level tank 72 is so arranged as to reflect a range of pool levels ranging from a level at or below the bottom of the surge weir openings 30 to a level above the top 17 of the pool perimeter gutter.

An electric sensor S6 in the pool level chamber 67 can be adjusted in position on bracket mounting bar 74 so as to sense any desired pool level as water level in the chamber 67, but is normally in a position to sense when the pool is at a predetermined level above the lower rim of openings 30 where there is too little skimming flow, and is in electric connection with the make-up water valve 47, so as to turn on the make-up water valve when the water level ceases contact with the sensor. Accordingly, the pool sensor S6 opens feed of fresh water to the pool when the pool is below the normal pool operating level, reflected as level N in the gutter 2, such as for example, when the amount of water is diminished for some reason, such as heavy use, and is therefore, being replenished, so that water is admitted from the feed line 55 into the line 48, and thence to the pool at fillspout 49.

A gutter level tank 75 is also provided, in fluid flow connection by the line 76 with the second gutter 2, at the bottom. In the chamber 68 of this level tank there are arranged the five gutter sebsors, S1, S2, S3, S4, and S5, each responding to a different level of water in the second gutter. The position of these sensors can also be adjusted up or down on bracket mounting bar 77, so that any desired combination of second gutter water levels can be detected, and an appropriate response effected.

The sensor S1 senses and responds to a first level L1 of water in the second gutter 2, corresponding to the pool level, at which skimming flow proceeds, and the pool water is at or above the lower rim of openings 30, at which level skimming flow proceeds. This sensor upon detecting level of the first skimming flow responds by closing the make-up water valve 47.

The second gutter sensor S2 senses a second and higher water level L2 in the second gutter, corresponding to a level of water in the second gutter above the normal operating level N when the pool is quiescent, with the surge weir passages 31 open, and normal skimming flow provided through the surge weir passages via openings 33 into the second gutter. The sensor responds to this level in the second gutter by opening the surge weirs, sending an electric signal to the piston 34 and cylinder 35 in the second gutter, and actuating the cylinder to withdraw the piston so that the surge weir flaps 32 are opened in the position shown in FIG. 10.

The third gutter sensor S3 senses a third and higher gutter water level L3, corresponding to the increased surge weir flow under light pool activity, When the water level reaches L3 because there is too much flow through the weirs, it is necessary to close the surge weirs, to prevent excessive gutter flow. Sensor S3 responds to this condition by actuating the cylinder and pushing out the piston, closing the flaps 32, and closing off the weirs. In this condition, some surge flow cascades over the top 17 of the perimeter gutter into gutter 1, but gutter 1 has adequate capacity to accommodate such flow.

A further increase in pool activity will lead to an increased flow of water across the top 17 of the perimeter gutter into the first gutter 1. Under medium pool activity, the flow fills the gutter 1, whereupon the excess spills over into the second gutter 2, through the passages 20. This increases the water level in the second gutter, to the level L4, sensed by the sensor S4, and increases the burden on the water recirculation system, which requires adjustment to accommodate the increased gutter flow.

Accordingly, this sensor S4 is in actuating connection with the main drain throttling valve 43, and closes the main drain valve, thus making it possible for the recirculation system 50 to accommodate the increased gutter overflow in line 40, the flow through which is now equal to that formerly reaching the recirculation system 50 from the combined volumes of the flows in the main drain line 44 and gutter overflow line 40.

Increased pool activity to the maximum activity level further increases the amount of water cascading across the top 17 of the perimeter gutter into gutter 1, and thence through the overflow openings 20 into gutter 2, with the result that the level in gutter 2 rises to level L5, sensed by the fifth sensor S5. This sensor opens the recirculation flow throttling valve 46, increasing the rate (and therefore the volume amount) of recirculation flow through the recirculation system 50, so as to accommodate the increased flow through the gutters. This is so designed as to accommodate any maximum flow that may be encountered during maximum activity in the pool.

It is apparent that instead of closing the main drain value 43, an increased recirculation system capacity can be achieved by opening the throttling valve 46. Thus, sensor S4 can be arranged to open valve 46 instead of valve 43.

It is thus apparent that the sensor system in accordance with the invention not only senses and responds to the water level in the pool, but also to water level in the second gutter, so as to respond to activity in the pool at any desired level, as reflected in higher gutter flow, and adjust the water recirculation system to accommodate it without gutter flooding or spill back into the pool.

The necessary gutter capacity to accommodate the increased gutter flow during periods of pool activity, whether low or intense, is provided by the second gutter, thus ensuring that at no time does water washed into the gutter return to the pool without having first passed through the pool cleansing and recirculation system via the filter. The response to three different levels of activity, low, moderate, and high, is fully automatic in all cases.

As pool activity decreases, and gradually returns to normal, the sensors are again actuated in the same order but in reverse sequence, so that the water recirculation system responds to the now decreased circulation through the gutters.

Thus, a decrease in the gutter level below level L5, sensed by sensor S5, results in a throttling back of recirculation flow throttling valve 46. When the level decreases further, to below the level L4, of sensor S4, the main drain throttling valve 43 is again opened. Further decrease to level L2 leads to the actuation via sensor S2 of the piston arrangement to open the flaps 32 and thus reopen the surge weirs, and this condition is maintained as long as the pool is quiescent, at normal pool operating level, i.e., at gutter level N. If for some reason, as for example, through heavy use, the amount of water decreases, so that level L1 is reached, the pool sensor S6 opens the make-up valve 47, to restore the pool level to normal, and when the pool level is normal, the gutter sensor S1 shuts off the valve 47, thus ensuring adequate skimming flow during periods of quiescence.

The water flow control system is consequently fully automatic, whether the flow to be accommodated is increasing or decreasing, and according to whether the activity in the pool is nil (quiescent), light, medium or heavy.

It will of course be appreciated that different degrees of activity intermediate these can be accommodated, by provision of additional sensors, and additional positions of either the recirculation flow throttling valve, or the gutter overflow and main drain systems.

A further modification of the water flow circulation layout for the pool perimeter gutter system is shown in FIG. 11. In this case, the gutter level tank 75 is replaced by a vacuum filter tank 57 in the gutter overflow line 40, in the same location as vacuum filter tank 99 of FIG. 9, before the pump, with the sensors in the filter bed (not shown). The recirculation system is similar to that of FIG. 9, and therefore like reference numerals are used for like parts.

There is a direct line connection 40 leading from the second gutter 2 and the first gutter 1 into the top of the vacuum filter tank 57, and then via line 62 to the valve 45 of the recirculation system 50, whence the line 62 leads to a pump 54. There is also main drain 41 in the bottom 42 of the swimming pool, leading via main drain line 44 to the bottom of vacuum filter tank 57. There is a main drain throttling valve 43 in the main drain line 44, so that this line can be closed off, or partially or fully opened, while the valve 45 in the vacuum filter tank line 62 closes off the vacuum filter tank. There is a recirculation flow throttling valve 46, which controls recirculation flow through the return feed line 52 leading to the water feed inlet 53 in the conduit 3. The valve 46 can be partially or fully opened, or closed, increasing the recirculation flow or decreasing it, as may be required. The pump 54 draws down a vacuum on the filter tank 57, and maintains circulation of water through the filter 57 and return feed line 52 to the conduit 3.

The make-up water valve 47 is in fluid flow connection via a line 48 to the fillspout 49 on the deck of the pool, permitting introduction of fresh water from the water supply, such as, for example, the water main supply at the pool location.

The water level sensing system of FIG. 11 is disposed in the vacuum filter tank 57, and is composed of five sensors S1, S2, S3, S4, and S5, detecting four different water levels in the filter tank, and one pool sensor, S6, detecting water level in the pool. The pool water level is sensed in pool level chamber 67, directly connected with the pool, while the filter tank level is directly correlated with water flow in the first and second gutters.

Pool level sensed in chamber 67 of the level tank 72 is communicated via the line 69, which is connected with the pool at 70, below the surface of the pool. The pool level tank 72 is so arranged as to reflect a range of pool levels ranging from the level of the bottom of the surge weir openings 30 to a level above the top 17 of the pool perimeter gutter.

An electric pool level sensor S6 in the pool level chamber 67 can be adjusted in position on bracket mounting bar 74 so as to sense any desired level of water in the chamber 67, but is normally in a position to sense when the pool is at predetermined level above the lower rim of openings 30, where there is too little skimming flow, and is in electric connection with the make-up water valve 47, so as to turn off the make-up water valve when the water level reaches the sensor. Accordingly, the sensor S6 cuts off feed or fresh water to the pool when the normal pool operating level has been reached, such as, for example, after the pool has been drained and is being refilled, or when the amount of water is for some reason diminished and is therefore being replenished.

In the chamber 78 of the vacuum filter tank 57 there are arranged five sensors, S1, S2, S3, S4 and S5, each responding to a different level of water in the tank. The position of these sensors can also be adjusted up or down on bracket mounting bar 79, so that any desired combination of water levels can be detected, and an appropriate response effected.

The first sensor S1 senses and responds to a first level L1 of water in tank 57 corresponding to the predetermined minimum pool water level at which the pool water level is below skimming flow level at the lower rim of openings 30, and must be replenished. This sensor upon detecting such a low level responds by opening the make-up water valve 47, so that water is admitted from the feed line 55 into the line 48, and thence to the pool at fillspout 49.

The second sensor S2 senses a second and higher water level L2 in the tank 57, above the normal operating pool water level, reflected in gutter level N, with the pool quiescent, with the surge weir passages 31 open, and normal skimming flow provided through the surge weir passages via openings 33 into the second gutter. The sensor responds to this level in the tank 57 by opening the surge weirs, sending an electric signal to the piston 34 and cylinder 35 in the second gutter, and actuating the cylinder to withdraw the piston, so that the surge weir flaps 32 are opened, in the position shown in the Figure.

The third sensor S3 senses a third and higher water level L3 in the tank 57, corresponding to the increased surge weir flow into the gutter under light pool activity. When the water level reaches L3, there is too much flow through the weirs, and it is necessary to close the surge weirs, to prevent excessive gutter flow. Sensor S3 responds to this condition by actuating the cylinder and pushing out the piston, closing the flaps 32, and closing off the weirs. In this condition, some surge flow cascades over the top of 17 of the perimeter gutter into gutter 1, but gutter 1 has adequate capacity to accommodate such flow.

A further increase in pool activity will lead to an increased flow of water across the top 17 of the perimeter gutter into the first gutter 1. Under medium pool activity, the flow fills the gutter 1, whereupon the excess spills over into the second gutter 2, through the passages 20. This increases the water flow in the second gutter, and in the gutter overflow return line 40, bringing the water level in the filter tank 57 to the level L4, sensed by the gutter sensor S4, and increases the burden on the water recirculation system, which requires adjustment to accommodate the increased gutter flow.

Accordingly, this sensor S4 is in actuating connection with the main drain throttling valve 43, and closes the main drain valve, thus making it possible for the recirculation system 50 to accommodate the increased gutter overflow in line 40, the flow through which is now equal to that formerly reaching the filter tank 57 and recirculation system 50 from the combined volumes of the flows in the main drain line 44 and gutter overflow line 40.

Increased pool activity to the maximum activity level further increases the amount of water cascading the top 17 of the perimeter gutter into gutter 1, and thence through the overflow openings 20 into the gutter 2, with the result that the level in tank 57 rises to level L5, sensed by the fifth sensor S5. This sensor opens the recirculation flow throttling valve 46, increasing the rate (and therefore the volume amount) of recirculation flow through the recirculation system 50, so as to accommodate the increased flow through the gutters. This is so designed as to accommodate any maximum flow that may be encountered during maximum activity in the pool.

As pool activity decreases, and gradually returns to normal, the sensors are again actuated in the same order but in reverse sequence, so that the water recirculation system responds to the now decreased circulation through the gutters.

Thus, a decrease in the water level below level L5, sensed by sensor S5, results in a throttling back of recirculation flow throttling valve 46. When the level decreases further, to below level L4, of sensor S4, the main drain throttling valve 43 is again opened. Further decrease to level L2 leads to the actuation via sensor S2 of the piston arrangement to open the flaps 32 and thus reopen the surge weirs, and this condition is maintained as long as the pool is quiescent, at normal pool operating level. If for some reason, as for example, through evaporation, the amount of water decreases, so that level L1 is reached, the sensor S1 opens the make-up valve 47, to restore the pool level to normal, whereupon sensor S6 shuts off the valve 47, thus ensuring adequate skimming flow during periods of quiescence.

The pool level and balance tank control system of FIG. 9, like that of FIGS. 1 to 5, is a water recirculating system which is controlled automatically by the swimming load. The most desirable of the various possible operating modes is selected automatically by the control system, dynamically guided by the amount of people in the pool, and their activity.

During quiescence (no persons in the pool) surface cleaning takes place through open surge weirs. As swimmers enter the pool causing displacement surge and waves, these weirs will automatically and positively close. As activity continues to increase, the main drain will close requiring all water from the swimming pool to be drawn from the perimeter overflow system channels. As the number of swimmers increases and the activity level increases, the recirculation (turnover) rate will automatically increase, improving the quality of filtration. As the bathers leave the pool, the recirculating rate will return to normal, and the main drain and surge weirs will open at predetermined levels, as the pool returns to its quiescent state. If after reaching quiescence the designed rate of surface cleaning is not being maintained, water will automatically be added to the swimming pool until this rate is achieved.

Functionally, the lower of the two gutters, the second gutter, accepts water through the surge weirs during quiescence, and continues to accept water until it reaches a predetermined level. At this level, the surge weirs automatically close, requiring all water to enter the first gutter of the perimeter overflow system by passing over the perimeter overflow system lip into the upper gutter. Water may flow from the upper first gutter directly to the filtration system, or it may pass through surge control ports into the lower second gutter. As the pool activity and number of swimmers decrease, the upper gutter will drain, the system will return to its normal recirculating rate, and the surge weirs will open.

The system thus responds automatically to user-activated dynamic demand, to determine the operating mode, continuously and automatically for the life of the swimming pool.

The perimeter gutters and weirs shown in FIGS. 1 to 11 are made of stainless steel, but it will, of course, be understood that other metals can be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter gutter and/or the weir of plastic material, either in whole or in part. These are plastics now available which are sufficiently strong to withstand the wear and tear of a perimeter gutter system, including, for example, acrylonitrile-butadiene-styrene resin, polycarbonate resin, polytetra-fluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred construction is from a sheet or several sheets of metallic or plastic material, which are formed into the desired configuration, as is seen in the cross-sectional drawings. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic, the same or different material from the gutter.

The use of modular units such as are shown in FIGS. 1 to 11 is preferred, because this permits mass production of the gutter and weir system at a point remote from the swimming pool, with easy and inexpensive transportation from that point to swimming pool construction sites anywhere in the world. The modular units can then be assembled on-site to form any type or configuration of swimming pool, and any desired weir arrangement. The modular units can be made in straight sections for rectangular or other straight-sided pool shapes, while curved sections can be made for pear-shaped, elliptical, circular, or other curved-side pool configurations.

The modular units can be fitted together by welding, soldering or brazing, in the case of metal units; by bonding, using various types of adhesives, in the case of metal or plastic units; or by heat-sealing, ultrasonic welding, or heat-bonding, in the case of thermoplastic plastic units. Plastic units which are not fully heat-cured can be bonded and then cured in situ to form a permanent bond on site, in the course of construction of the pool.

The perimeter gutter and weir system of the invention can be used completely around the perimeter of a pool, or only partially around the pool perimeter, as desired. The most uniform skimming action and gutter action is, of course, obtained when the entire perimeter of the pool is provided with such a gutter and weir.

While construction of the gutter and weir in the form of modular units has been described, it will also be appreciated from FIGS. 1 to 11 that the gutter and weir system can be formed on-site in the configurations shown using concrete or plastic material, and can form an integral part of the pool wall, by casting or pouring into suitable frames, so that the material can harden and set in the desired pool and skimmer outlet shape. The construction of the gutter system is sufficiently simple so that this type of technique can be employed with good results. Since this requires more hand-work, however, and is therefore a more costly method of construction, it would not usually be preferred, particularly in the case of large pools, where construction costs may be too high to permit the luxury of a handmade gutter system on the pool site.

The gutter and weir system can also be made from bricks or tiles, which are built up in the desired configuration. These can be the usual types of materials, preferably with a ceramic facing, so that it is leak-proof, with the tiles being bonded to together with water-resistance adhesive or cement.

The swimming pool can be equipped with any type of water filtration and cleaning recirculation system. The gutters usually feed water therein to such systems by gravity. However, recirculation pumps can be provided, and the gutters can also be provided with jet water inlets to direct a driving flow of water along the gutter, to flush out the gutters, and to dirve water along the gutter towards the water recirculation system. Such jet water inlets are described in U.S. Pat. No. 2,932,397, to Ogden, dated Apr. 12, 1960.

Other variations and modifications of the invention will be apparent to those skilled in the art.

Having regard to the foregoing disclosure, the following is claimed as the inventive and patentable embodiments thereof:

1. An automated water level and skimming flow perimeter gutter control system for swimming pools comprising, in combination, a gutter conduit for disposition about the perimeter of a swimming pool, receiving overflow across a top edge thereof and adapted to carry water at a level below a predetermined level in the swimming pool; a make-up valve which when open allows feed from a water make-up supply to proceed to the pool and when closed stops such feed; and at least two water level-responsive sensors in operative controlling relation to the valve, one of the two sensors sensing and directy responding to the level of water in the pool, the other of the two sensors sensing and directly responding to the level of overflow, one of said sensors opening the valve to allow feed from the water make-up supply to proceed to the pool whenever pool or overflow level falls below a predetermined level, and the other of the two said sensors closing the valve whenever pool or overflow level reaches a predetermined level, whereby only one of the sensors opens the make-up valve, and the other one of the sensors closes the make-up valve.

2. An automated water level and skimming flow perimeter gutter control system for swimming pools in accordance with claim 1, comprising a second gutter receiving skimming flow and also providing additional gutter capacity for extraordinary gutter flow, including relief flow from the first gutter in the event of considerable activity in the pool.

3. An automated water level and skimming flow perimeter gutter control system for swimming pools in accordance with claim 1, wherein the sensor responsive to overflow senses water level in a gutter.

4. An automatated water level and skimming flow perimeter gutter control system for swimming pools in accordance with claim 1, comprising a balance tank and wherein the sensor responsive to overflow senses water level in the balance tank.

5. An automated water level and skimming flow perimeter gutter control system for swimming pools in accordance with claim 1, comprising a vacuum filter tank and wherein the sensor responsive to overflow senses water level in the vacuum filter tank.

6. An automated water level and skimming flow perimeter gutter control system for swimming pools in accordance with claim 1, wherein the sensor that senses a first level of water in the gutter corresponding to below-normal skimming flow when this is below a predetermined level opens the valve allowing feed of make-up water to the pool; and the sensor that senses water level in the pool is arranged to close the valve whenever the pool water level reaches a predetermined level.

7. An automated water level and skimming flow perimeter gutter control system for swimming pools in accordance with claim 1, wherein the sensor that senses water level in the pool when this is below a predetermined level opens the valve allowing feed of make-up water to the pool; and the sensor that senses overflow water level corresponding to normal skimming flow is arranged to close the valve whenever overflow water level reaches the normal skimming flow level.

8. An automated water level and skimming flow perimeter gutter control system for swimming pools in accordance with claim 1, comprising a skimming weir having a weir closure movable between open and closed positions; and a third sensor which senses a predetermined overflow water level at which skimming flow corresponds to a greater-than-normal skimming flow, and closes the weir closure, arresting skimming flow and retaining water in the pool, but allowing flow surges to proceed over the top edge of the gutter into the gutter.

9. An automated water level and skimming flow perimeter gutter control system for swimming pools in accordance with claim 1, comprising a recirculation system including a main drain valve movable between open and closed positions, controlling flow via the main drain from the pool, the recirculation system receiving and recirculating pool water from the gutter and the main drain, and a third sensor which senses a predetermined overflow water level at which overflow exceeds normal recirculation flow, and closes the main drain valve, so that the recirculation system accepts only pool water flowing into the recirculation system from the gutter.

10. An automated water level and skimming fow perimeter gutter control system for swimming pools in accordance with claim 1, comprising a recirculation system including a recirculating flow throttling control valve movable between open and closed positions, controlling flow through the recirculation system to and from the pool, and a third sensor which senses a predetermined overflow water level at which the capacity of the recirculation system is exceeded, and opens the recirculating flow throttling control valve to increase the amount of water drawn through the recirculation system, to accommodate this excess flow.

11. An automated water level and skimming flow perimeter gutter control system for swimming pools in accordance with claim 10, comprising a recirculation system including a filter and a line bypassing the filter having a valve movable between open and closed positions, and opening and cosing the bypass line, and the third sensor opens and closes the bypass line valve.

12. An automated water level and skimming flow perimeter gutter control system for swimming pools in accordance with claim 10, comprising a recirculation system including a main drain valve movable between open and closed positions controlling flow via the main drain from the pool, and a recirculating flow throttling control valve movable between open and closed positions, and in the open position having a plurality of positions providing greater and lesser throttling of the recirculation flow, the recirculation system receiving and recirculating pool water from the gutter and main drain and water return flow via the recirculating flow throttling control valve to the pool; and the third sensor closes the main drain valve, so that the recirculation system accepts only pool water flowing into the recirculation system from the gutter; and a fourth sensor which senses a predetermined overflow water level at which the capacity of the recirculation system is exceeded, and opens the recirculating flow throttling control valve to increase the amount of water drawn through the recirculation system, to accommodate this excess flow.

13. An automated water level and skimming flow perimeter gutter control system for swimming pools in accordance with claim 1, comprising a skimming weir having a weir closure movable between open and closed positions, and a recirculation system including a main drain valve movable between open and closed positions, controlling flow via the main drain from the pool and a recirculating flow throttling control valve, flow in the recirculation system proceeding through the recirculating flow throttling control valve in return to the pool; a third sensor which closes the skimming weir closure, arresting skimming flow and retaining water in the pool, but allowing flow surges to proceed into the gutter; a fourth sensor which senses a predetermined overflow water level at which overflow exceeds normal recirculation flow, and closes the main drain valve so that the recirculation system accepts only pool water flowing into the recirculation system from the gutter; and a fifth sensor which senses a predetermined overflow water level at which the capacity of the recirculation system is exceeded, and opens the recirculating flow throttling control valve to increase the amount of water drawn through the recirculation system, to accommodate this excess flow.

14. An automated pool perimeter skimming gutter water level control system comprising, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit, the top of the wall being placed at a height to maintain a predetermined water level in the pool, to provide a skimming flow of water over the top of such predetermined water level in the pool, and to allow excessive flows, wave actions and surges to flow over the top of the wall into the gutter conduit; a water cleaning and recirculating system for collecting water from the pool and water flowing into and along the gutter conduit, cleaning it, and returning it to the pool; a make-up valve movable between open and closed positions and controlling feed of make-up water to the pool; a flow control valve movable between positions providing, respectively, low and high recirculation capacity for gutter flow; at least two water-level responsive sensors in operative controlling relation to the make-up valve, one of the two sensors sensing and directly responding to the level of water in the pool, the other of the two sensors sensing and directly responding to the level of overflow; one of said sensors sensing a first water level in the overflow downstream of the pool corresponding to a less than the predetermined water level in the pool, and responsive thereto to open the make-up valve and feed water to the pool; and the other of the two sensors sensing a predetermined water level in the pool characteristic of normal quiescent pool skimming flow and responsive thereto to close the make-up valve and stop water feed initiated by the first sensor; whereby only one of the sensors opens the make-up valve, and the other one of the sensors closes the make-up valve and a second overflow sensor sensing a higher level in the overflow downstream of the pool characteristic of a high degree of water flow, wave action and surges into the gutter conduit, and responsive thereto to move the flow control valve and increase water recirculation system capacity to recirculate such increased overflow and prevent wash-back from a gutter conduit to the pool.

15. An automated pool perimeter skimming gutter water level control system comprising, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; the top of the wall being placed at a height to maintain a predetermined water level in the pool; to provide a skimming flow of water over the top of the wall at such predetermined water level in the pool, and to allow excessive flows, wave actions and surges to flow over the top of the wall into the gutter conduit; a water cleaning and recirculating system for collecting water from the pool and water flowing into and along the gutter conduits, cleaning it, and returning it to the pool; and including a make-up valve movable between open and closed positions and controlling feed of make-up water to the pool; and a water recirculation throttling valve controlling the capacity for recirculating water flow of the water cleaning and recirculating system; at least two water-level responsive sensors in operative controlling relation to the make-up valve, one of the two sensors sensing and directly responding to the level of water in the pool, and the other of the two sensors sensing and directly responding to the level of overflow; one of said sensors sensing a first water level in the overflow downstream of the pool corresponding to a less than the predetermined water level in the pool, and responsive thereto to open the make-up valve and feed water to the pool; and the other of the two sensors sensing a predetermined water level in the pool characteristic of normal quiescent pool skimming flow and responsive thereto to close the make-up valve and stop water feed initiated by the first sensor whereby only one of the sensors opens the make-up valve, and the other one of the sensors closes the make-up valve; and a second overflow sensor sensing a higher level in the overflow characteristic of a high degree of water flow, wave actions and surges into the gutter conduit, and responsive thereto to move the water recirculation throttling valve and increase recirculation system capacity to accommodate such increased overflow, and prevent wash-back from a gutter conduit to the pool.

16. An automated pool perimeter skimming gutter water level control system comprising, in combination, a gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; at least one surge weir having a weir closure movable between open and closed positions and disposed through the retaining wall below the top thereof, at a height to maintain a predetermined water level in the pool, and in the open position of the closure to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a water cleaning and recirculating system for collecting water from the pool and water flowing into and along the gutter conduit, cleaning it, and returning it to the pool; a make-up valve movable between open and closed positions and controlling feed to make-up water to the pool; a flow control valve movable between positions providing, respectively, low and high recirculation capacity for gutter flow; at least two water-level responsive sensors in operative controlling relation to the make-up valve, one of the two sensors sensing and directly responding to the level of water in the pool, and the other of the two sensors sensing and directly responding to the level of overflow; one of said sensors sensing a first water level in the overflow downstream of the pool corresponding to a less than the predetermined water level in the pool, and responsive thereto to open the make-up valve and feed water to the pool; and the other of the two sensors sensing the predetermined water level in the pool characteristic of normal quiescent pool skimming flow and responsive thereto to close the make-up valve and stop water feed initiated by the first sensor whereby only one of the sensors opens the make-up valve, and the other one of the sensors closes the make-up valve; a second overflow sensor sensing a second higher level in the overflow downstream of the pool characteristic of a low threshold of pool activity but excessive weir skimming flow, and responsive thereto to close at least one weir closure; and a third overflow sensor sensing a third higher level in the overflow downstream of the pool characteristic of a high degree of water flow, wave actions and surges into the gutter conduit, and responsive thereto to move the flow control valve and increase water recirculation system capacity to recirculate such increased overflow and prevent wash-back from a gutter conduit to the pool.

17. A twin-gutter automated pool perimeter skimming gutter water level control system comprising, in combination, a first gutter conduit for disposition about the perimeter of a swimming pool, and adapted to carry water at a level below a predetermined level of water in the swimming pool; a second gutter conduit for disposition about the perimeter of a swimming pool, and adapted to carry water at a level below a predetermined level of water in the swimming pool; a retaining wall on the pool side of the gutter conduit, over the top of which wall water may flow from the pool into a gutter conduit; the top of the wall being placed at a height to maintain a predetermined water level in the pool, to provide a skimming flow of water at such predetermined water level in the pool, and to allow excessive flows, wave actions and surges to flow over the top of the wall into a gutter conduit; a water cleaning and recirculating system for collecting water from the pool and water flowing into and along the first and second gutter conduits, cleaning it, and returning it to the pool; a make-up valve movable between open and closed positions and controlling feed of make-up water to the pool; a flow control valve movable between positions providing, respectively, low and high recirculation capacity for gutter flow; at least two water-level responsive sensors in operative controlling relation to the make-up valve, one of the two sensors sensing and directly responding to the level of water in the pool, and the other of the two sensors sensing and directly responding to the level of overflow; one of said sensors sensing a first water level in the overflow corresponding to a less than the predetermined water level in the pool, and responsive thereto to open the make-up valve and feed water to the pool; and the other of the two sensors sensing the predetermined water level in the pool characteristic of normal quiescent pool skimming flow and responsive thereto to close the make-up valve and stop water feed initiated by the first overflow sensor whereby only one of the sensors opens the make-up valve, and the other one of the sensors closes the make-up valve; and a second overflow sensor sensing a second higher lever in the overflow downstream of the pool characteristic of a high degree of water flow, wave actions and surges into the gutter conduit, and responsive thereto to move the flow control valve and increase water recirculation system capacity to recirculate such increased overflow and prevent wash-back from a gutter conduit to the pool.

18. A twin-gutter automated pool perimeter skimming gutter water level control system comprising, in combination, a first gutter conduit for disposition about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit for disposition about the perimeter of a swimming pool, and adapted to carry water at a level below a predetermined level of water in the swimming pool; the top of the wall being placed at a height to maintain a predetermined water level in the pool, to provide a skimming flow of water over the top of the wall at such predetermined water level in the pool, and allow excessive flows, wave actions and surges to flow over the top of the wall into the first gutter conduit; a water cleaning and recirculating system for collecting water from the pool and water flowing into and along the first and second gutter conduits, cleaning it, and returning it to the pool; and including a make-up valve movable between open and closed positions and controlling feed of make-up water to the pool; and a water recirculation throttling valve controlling the capacity for recirculating water flow of the water cleaning and recirculating system; at least two water-level responsive sensors in operative controlling relation to the make-up valve, one of the two sensors sensing and directly responding to the level of water in the pool, and the other of the two sensors sensing and directly responding to the level of overflow; one of said sensors sensing a first water level in the overflow downstream of the pool corresponding to a less than the predetermined water level in the pool, and responsive thereto to open the make-up valve and feed water to the pool; and the other of the two sensors sensing a predetermined water level in the pool characteristic of normal quiescent pool skimming flow and responsive thereto to close the make-up valve and stop water feed initiated by the first gutter sensor whereby only one of the sensors opens the make-up valve, and the other one of the sensors closes the make-up valve; and a second overflow sensor sensing a higher level in the overflow downstream of the pool characteristic of a high degree of water flow, wave actions and surges into the first gutter conduit, and responsive thereto to move the water circulation throttling valve and increase recirculation system capacity to accommodate such increased overflow, and prevent wash-back from a gutter conduit to the pool.

19. An automated pool perimeter skimming gutter water level control system comprising, in combination, a first gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; a second gutter conduit for disposition about the perimeter of a swimming pool, and adapted to carry water at a level below a predetermined level of water in the swimming pool; at least one surge weir having a weir closure movable between open and closed positions, and disposed through the retaining wall below the top thereof, at a height to maintain a predetermined water level in the pool, and in the open position of the closure to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; a make-up valve movable between open and closed positions and controlling feed of make-up water to the pool; a flow control valve movable between positions providing, respectively, low and high recirculation capacity for gutter flow; at least two water-level responsive sensors in operative controlling relation to the make-up valve, one of the two sensors sensing and directly responding to the level of water in the pool, and the other of the two sensors sensing and directly responding to the level of overflow; one of said sensors sensing a first water level in the overflow downstream of the pool corresponding to a less than the predetermined water level in the pool, and responsive thereto to open the make-up valve and feed water to the pool; and the other of the two sensors sensing the predetermined water level in the pool corresponding to a level in the overflow downstream of the pool characteristic of normal quiescent pool skimming flow and responsive thereto to close the make-up valve and stop water feed initiated by the first overflow sensor whereby only one of the sensors opens the make-up valve, and the other one of the sensors closes the make-up valve; a second overflow sensor sensing a second higher level in the overflow downstream of the pool characteristic of a low threshold of pool activity but excessive weir skimming flow and responsive thereto to close at least one weir closure; and a third overflow sensor sensing a third higher level in the overflow downstream of the pool characteristic of a high degree of water flow, wave actions and surges into the first gutter conduit, and responsive thereto to move the flow control valve to increase water recirculation system capacity to recirculate such increased overflow and prevent wash-back from a gutter conduit to the pool.

20. An automated pool perimeter skimming gutter with water level control comprising, in combination, a first gutter conduit for disposition about the perimeter of a swimming pool, and adapted to carry water at a level below a predetermined level of water in the swimming pool; a retaining wall on the pool side of the gutter conduit, over the top of which wall water may flow from the pool into the gutter conduit; a second gutter conduit in fluid flow communication with the first gutter conduit at a predetermined maximum water level in the first gutter conduit for disposition about the perimeter of a swimming pool, and adapted to carry water at a level below a predetermined level of water in the swimming pool and in the first gutter conduit; at least one surge weir having a weir closure movable between open and closed positions and disposed through the retaining wall below the top thereof, at a height to maintain a predetermined water level in the pool, and in the open position of the closure to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the poll and water flowing into and along the first and second gutter conduits, cleaning it, and returning it to the pool; a make-up valve movable between open and closed positions and controlling feed of make-up water to the pool; a flow control valve movable between positions providing, respectively, low and high recirculation capacity for gutter flow; a first sensor sensing a first water level in the second gutter corresponding to a less than the predetermined water level in the pool, and responsive thereto to open the make-up valve and feed water to the pool; a second sensor sensing the predetermined water level in the pool corresponding to a second higher level in the second gutter characteristic of normal quiescent pool skimming flow and responsive thereto to close the make-up valve and stop water feed initiated by the first sensor; a third sensor sensing a third higher level in the second gutter characteristic of a low threshhold of pool activity but excessive weir skimming flow, and responsive thereto to close at least one weir closure; and a fourth sensor sensing a fourth higher level in the second gutter characteristic of a high degree of water flow, wave action and surges into the first gutter conduit, and responsive thereto to move the flow control valve and increase water recirculation system capacity to recirculate such increased gutter flow and prevent wash-back from a gutter conduit to the pool.

21. An automated pool perimeter skimming gutter with water level control according to claim 20, wherein the pool comprises a main drain leading to the water recirculation system and a main drain valve movable between positions opening and closing the main drain, and a fifth sensor which senses a fifth water level in the second gutter, intermediate the third and fourth water levels, and is responsive thereto to close the main drain valve, thereby increasing water recirculation capacity for gutter flow.

22. An automated pool perimeter skimming gutter in accordance with claim 20 in which the first gutter conduit is an open trough.

23. An automated pool perimeter skimming gutter in accordance with claim 20 in which the fluid flow connection between the first and second gutter conduits is in the form of a plurality of slots at the predetermined maximum level of water in the first gutter conduit.

24. An automated pool perimeter skimming gutter in accordance with claim 20 in which a water-feed conduit is provided for feed of fresh water into the pool.

25. An automated pool perimeter skimming gutter in accordance with claim 24, in which the water feed conduit is disposed beside the first gutter conduit.

26. An automated pool perimeter skimming gutter in accordance with claim 24, in which the water feed conduit is disposed within the first gutter conduit.

27. An automated pool perimeter skimming gutter in accordance with claim 24, in which the water feed conduit is disposed within the second gutter conduit.

28. An automated pool perimeter skimming gutter in accordance with claim 20 in which the two gutter conduits are separated by a common wall, and the fluid flow connection between the two gutters is provided by a plurality of openings through the wall.

29. An automated pool perimeter skimming gutter in accordance with claim 20, comprising at least one jet water feed inlet in either the first or the second gutter conduit or both, for driving water and debris along the gutter conduit.

30. An automated pool permiter skimming gutter in accordance with claim 20, in the form of a modular wall unit adapted to be assembled end-to-end with other such units to form the perimeter gutter wall of a swimming pool.

31. An automated pool perimeter skimming gutter in accordance with claim 20, in which the second gutter is within the poolside retaining wall of the first gutter conduit.

32. An automated pool perimeter skimming gutter in accordance with claim 20, in which the second gutter is within an external peripheral wall of the first gutter conduit.

33. A swimming pool comprising side walls and a bottom adapted to retain water therewithin, and, extending about the upper perimeter of at least a portion of one side wall thereof, a perimeter skimming gutter comprising, in combination, a gutter conduit disposed about the perimeter of the swimming pool, receiving overflow across a top edge thereof and adapted to carry water at a level below a predetermined level in the swimming pool; a make-up valve which when open allows feed from a water make-up supply to proceed to the pool and when closed stops such feed; and at least two water level-responsive sensors in operative controlling relation to the valve, a first sensor sensing and directly responding to the level of water in the pool, and a second sensor sensing and directly responding to the level of overflow, one of said sensors opening the valve to allow feed down from a water make-up supply to proceed to the pool whenever pool or overflow level falls below a predetermined level, and the other of said sensors closing the valve whenever pool or overflow level reaches a predetermined level, whereby only one of the sensors opens the make-up valve, and the other one of the sensors closes the make-up valve.

34. A swimming pool in accordance with claim 33, in which the perimeter skimming gutter comprises a second gutter receiving skimming flow and also providing additional gutter capacity for extraordinary gutter flow, including relief flow from the first gutter in the event of considerable activity in the pool.

35. A swimming pool in accordance with claim 33, in which the sensor responsive to overflow level senses water level in a gutter.

36. A swimming pool in accordance with claim 33, comprising a balance tank and in which the sensor responsive to an overflow level senses water level in the balance tank.

37. A swimming pool in accordance with claim 33, comprising a vacuum filter tank and in which the sensor responsive to an overflow level senses water level in the vacuum filter tank.

38. A swimming pool in accordance with claim 33, in which the sensor that senses a first level of water in the gutter corresponding to below-normal skimming flow when this is below a predetermined level opens the valve allowing feed of make-up water to the pool; and the sensor that senses water level in the pool is arranged to close the valve whenever the pool water level reaches a predetermined level.

39. A swimming pool in accordance with claim 33, in which the sensor that senses water level in the pool when this is below a predetermined level opens the valve allowing feed of make-up water to the pool; and the other sensor that senses overflow water level corresponding to normal skimming flow is arranged to close the valve whenever the overflow water level reaches the normal skimming flow level.

40. A swimming pool in accordance with claim 33, comprising a skimming weir having a weir closure movable between open and closed positions; and a third sensor which senses a predetermined overflow water level at which skimming flow corresponds to a greater-than-normal skimming flow, and closes the weir closure, arresting skimming flow and retaining water in the pool, but allowing flow surges to proceed over the top edge of the gutter into the gutter.

41. A swimming pool in accordance with claim 33, comprising a recirculation system including a main drain valve movable between open and closed positions, controlling flow via the main drain from the pool, the recirculation system receiving and recirculating pool water from the gutter and the main drain, and a third sensor which senses a predetermined overflow water level at which overflow exceeds normal recirculation flow, and closes the main drain valve, so that the recirculation system accepts only pool water flowing into the recirculation system from the gutter.

42. A swimming pool in accordance with claim 33, comprising a recirculation system including a recirculating flow throttling control valve movable between open and closed positions, controlling flow through the recirculation system to and from the pool, and a third sensor which senses a predetermined overflow water level at which the capacity of the recirculation system is exceeded, and opens the recirculating flow throttling control valve to increase the amount of water drawn through the recirculation system, to accommodate this excess flow.

43. A swimming pool in accordance with claim 33, comprising a recirculation system including a filter and a line bypassing the filter having a valve movable between open and closed positions, and opening and closing the bypass line, and a third sensor which opens and closes the bypass line valve.

44. A swimming pool in accordance with claim 33, comprising a recirculation system including a main drain valve movable between open and closed positions controlling flow via the main drain from the pool, and a recirculating flow throttling control valve movable between open and closed positions, and in the open position having a plurality of positions providing greater and lesser throttling of the recirculation flow, the recirculation system receiving and recirculating pool water from the gutter and main drain and water return flow via the recirculating flow throttling control valve to the pool; a third sensor which closes the main drain valve, so that the recirculation system accepts only pool water flowing into the recirculation system from the gutter; and a fourth sensor which senses a predetermined overflow water level at which the capacity of the recirculation system is exceeded, and opens the recirculating flow throttling control valve to increase the amount of water drawn through the recirculation system, to accommodate this excess flow.

45. A swimming pool in accordance with claim 33, comprising a skimming weir having a weir closure movable between open and closed positions, and a recirculation system including a main drain valve movable between open and closed positions, controlling flow via the main drain from the pool and a recirculating flow throttling control valve, flow in the recirculation system proceeding through the recirculating flow throttling control valve in return to the pool; a third sensor which closes the skimming weir closure, arresting skimming flow and retaining water in the pool, but allowing flow surges to proceed into the gutter; a fourth sensor which senses a predetermined overflow water level at which overflow exceeds normal recirculation flow, and closes the main drain valve so that the recirculation system accepts only pool water flowing into the recirculation system from the gutter; and a fifth sensor which senses a predetermined overflow water level at which the capacity of the recirculation system is exceeded, and opens the recirculating flow throttling control valve to increase the amount of water drawn through the recirculation system, to accommodaate this excess flow.

46. A swimming pool in accordance with claim 33, comprising a retaining wall on the pool side of the gutter conduit, over the top of which wall water may flow from the pool into the gutter conduit, the top of the wall being placed at a height to maintain a predetermined water level in the pool, to provide a skimming flow of water over the top at such predetermined water level in the pool, and to allow excessive flows, wave actions and surges to flow over the top of the wall into the gutter conduit; a water cleaning and recirculating system for collecting water from the pool and water flowing into and along the gutter conduit, cleaning it, and returning it to the pool; a flow control valve movable between positions providing, respectively, low and high recirculation capacity for gutter flow; the sensor sensing a first water level in the gutter downstream of the pool corresponding to a less than the predetermined water level in the pool being responsive thereto to open the make-up valve and feed water to the pool; the sensor sensing a predetermined water level in the pool characteristic of normal quiescent pool skimming flow being responsive thereto to close the make-up valve and stop water feed initiated by the first overflow sensor; and a third sensor sensing a higher level in the overflow downstream of the pool characteristic of a high degree of water flow wave action and surges into the gutter conduit, and responsive thereto move the flow control valve and increase water recircultion system capacity to recirculate such incresed overflow and prevent wash-back from a gutter conduit to the pool.

47. A swimming pool in accordance with claim 46, in which the flow control valve is a water recirculation throttling valve controlling the capacity for recirculating water flow of the water cleaning and recirculating system; the third sensor sensing a higher level in the overflow characteristic of a high degree of water flow, wave action and surges into the gutter conduit being responsive thereto to move the water recirculation throttling valve and increase recirculation system capacity to accommodate such increased overflow, and prevent wash-back from a gutter conduit to the pool.

48. A swimming pool in accordance with claim 33, comprising a retaining wall on the pool side of the gutter conduit, over the top of which wall water may flow from the pool into the gutter conduit; at least one surge weir having a weir closure movable between open and closed positions and disposed through the retaining wall below the top thereof, at a height to maintain a predetermined water level in the pool, and in the open position of the closure to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the gutter conduit; a third sensor sensing a second higher level in the overflow downstream of the pool characteristic of a low threshold of pool activity but excessive weir skimming flow, and responsive thereto to close at least one weir closure; and a fourth sensor sensing a third higher level in the overflow downstream of the pool characteristic of a high degree of water flow, wave action and surges into the gutter conduit, and responsive thereto to move the flow control valve and increase water recirculation system capacity to recirculate such increased overflow and prevent wash-back from a gutter conduit to the pool.

49. A swimming pool in accordance with claim 33, comprising a first gutter conduit disposed about the perimeter of the swimming pool, and adapted to carry water at a level below a predetermined level of water in the swimming pool; a second gutter conduit disposed about the perimeter of the swimming pool, and adapted to carry water at a level below a predetermined level of water in the swimming pool; a retaining wall on the pool side of the gutter conduit, over the top of which wall water may flow from the pool into a gutter conduit; the top of the wall being placed at a height to maintain a predetermined water level in the pool, to provide a skimming flow of water at such predetermined water level in the pool, and to allow excessive flows, wave actions and surges to flow over the top of the wall into a gutter conduit; a water cleaning and recirculating system for collecting water from the pool and water flowing into and along the first and second gutter conduits, cleaning it, and returning it to the pool; a flow control valve movable between positions providing, respectively, low and high recirculation capacity for gutter flow; and a third sensor sensing a second higher level in the overflow downstream of the pool characteristic of a high degree of water flow, wave action and surges into the gutter conduit, and responsive thereto to move the flow control valve and increase water recirculation system capacity to recirculate such increased overflow and prevent washback from a gutter conduit to the pool.

50. A swimming pool in accordance with claim 33, comprising a first gutter conduit disposed about the perimeter of a swimming pool, and adapted to carry water at a level below a predetermined level of water in the swimming pool; a retaining wall on the pool side of the first gutter conduit, over the top of which wall water may flow from the pool into the first gutter conduit; a second gutter conduit disposed about the perimeter of the swimming pool, and adapted to carry water at a level below a predetermined level of water in the swimming pool; the top of the wall being placed at a height to maintain a predetermined water level in the pool, to provide a skimming flow of water over the top of the wall at such predetermined water level in the pool, and allow excessive flows, wave actions and surges to flow over the top of the wall into the first gutter conduit; a water cleaning and recirculating system for collecting water from the pool and water flowing into and along the first and second gutter conduits, cleaning it, and returning it to the pool; and including a water recirculation throttling valve controlling the capacity for recirculating water flow of the water cleaning and recirculating system; and a third sensor sensing a higher level in the overflow downstream of the pool characteristic of a high degree of water flow, wave action and surges into the first gutter conduit, and responsive thereto to move the water circulation throttling valve and increase recirculation system capacity to accommodate such increased overflow, and prevent wash-back from a gutter conduit to the pool.

51. A swimming pool in accordance with claim 33, comprising a retaining wall on the pool side of the gutter conduit, over the top of which wall water may flow from the pool into the gutter conduit; a second gutter conduit disposed about the perimeter of the swimming pool, and adapted to carry water at a level below a predetermined level of water in the swimming pool; at least one surge weir having a weir closure movable between open and closed positions, and disposed through the retaining wall below the top thereof, at a height to maintain a predetermined water level in the pool, and in the open position of the closure to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; a flow control valve movable between positions providing, respectively, low and high recirculation capacity for gutter flow; a third sensor sensing a second higher level in the overflow downstream of the pool characteristic of a low threshold of pool activity but excesive weir skimming flow and responsive thereto to close at least one weir closure; and a fourth sensor sensing a third higher level in the overflow downstream of the pool characteristic of a high degree of water flow, wave action and surges into the first gutter conduit, and responsive thereto to move the flow control valve to increase water recirculation system capacity to recirculate such increased overflow and prevent wash-back from a gutter conduit to the pool.

52. A swimming pool in accordance with claim 33, comprising a first gutter conduit disposed about the perimeter of the swimming pool, and adapted to carry water at a level below a predetermined level of water in the swimming pool; a retaining wall on the pool side of the gutter conduit, over the top of which wall water may flow from the pool into the gutter conduit; a second gutter conduit in fluid flow communication with the first gutter conduit at a predetermined maximum water level in the first gutter conduit and disposed about the perimeter of the swimming pool, and adapted to carry water at a level below a predetermined level of water in the swimming pool and in the first gutter conduit; at least one surge weir having a weir closure movable between open and closed positions and disposed through the retaining wall below the top thereof, at a height to maintain a predetermined water level in the pool, and in the open position of the closure to provide a skimming flow of water through the weir at such predetermined water level in the pool, the top of the wall being spaced above the weir at a height to retain the pool water within the pool perimeter when the weir is closed at water flows, wave actions and surges up to a predetermined minimum, while allowing excessive flows, wave actions and surges beyond such minimum to flow over the top of the wall into the first gutter conduit; a water cleaning and recirculating system for collecting water from the pool and water flowing into and along the first and second gutter conduits, cleaning it, and returning it to the pool; a flow control valve movable between positions providing, respectively, low and high recirculation capacity for gutter flow; the sensor sensing a first water level in the second gutter corresponding to a less than the predetermined water level in the pool being responsive thereto to open the make-up valve and feed water to the pool; the sensor sensing the predetermined water level in the pool corresponding to a second higher level in the second gutter characteristic of normal quiescent pool skimming flow being responsive thereto to close the make-up valve and stop water feed initiated by the first sensor; a third sensor sensing a third higher level in the second gutter characteristic of a low threshhold of pool activity but excessive weir skimming flow, and responsive thereto to close at least one weir closure; and a fourth sensor sensing a fourth higher level in the second gutter characteristic of a high degree of water flow, wave action and surges into the first gutter conduit, and responsive thereto to move the flow control valve and increase water recirculation system capacity to recirculate such increased gutter flow and prevent wash-back from a gutter conduit to the pool.

53. A swimming pool in accordance with claim 52, wherein the pool comprises a main drain leading to the water recirculation system and a main drain valve movable between positions opening and closing the main drain, and a fifth sensor which senses a fifth water level in the second gutter, intermediate the thirrd and fourth water levels, and is responsive thereto to close the main drain valve thereby increasing water recirculation capacity for gutter flow.

54. A swimming pool in accordance with claim 52, in which the first gutter conduit is an open trough.

55. A swimming pool in accordance with claim 52, in which the fluid flow connection between the first and second gutter conduits is in the form of a plurality of slots at the predetermined maximum level of water in the first gutter conduit.

56. A swimming pool in accordance with claim 52, in which a waterfeed conduit is provided for feed of fresh water into the pool.

57. A swimming pool in accordance with claim 56, in which the water feed conduit is disposed beside the first gutter conduit.

58. A swimming pool in accordance with claim 56, in which the water feed conduit is disposed within the first gutter conduit.

59. A swimming pool in accordance with claim 56, in which the water feed conduit is disposed within the second gutter conduit.

60. A swimming pool in accordance with claim 52, in which the two gutter conduits are separated by a common wall, and the fluid flow connection between the two gutters is provided by a plurality of openings through the wall.

* * * * *

UNITED STATES PATENT OFFICE

CERTIFICATE OF CORRECTION

Patent No. 4,133,058 Dated January 9, 1979

Inventor(s) William H. Baker

It is certified that error appears in the above-identified patent and that said Letters Patent are hereby corrected as shown below:

| | | |
|---|---|---|
| Column 2, line 50 | : | "extraodinary" should be --extraordinary-- |
| Column 4, line 55 | : | "dispostion" should be --disposition-- |
| Column 6, line 39 | : | "predeterined" should be --predetermined-- |
| Column 10, line 16 | : | "adpated" should be --adapted-- |
| Column 11, line 29 | : | "predetermind" should be --predetermined-- |
| Column 15, line 34 | : | "n" should be --N-- |
| Column 18, line 54 | : | "I5" should be --L5-- |
| Column 21, line 61 | : | "If" should be --It-- |
| Column 22, line 22 | : | "stainlesssteel" should be --stainless steel-- |
| Column 23, line 46 | : | "response" should be --responds-- |
| Column 25, line 26 | : | After "67" please insert --can-- |
| line 67 | : | "corresposning" should be --corresponding-- |
| Column 26, line 44 | : | "decreaes" should be --decreases-- |
| line 57 | : | "quiesecent" should be --quiescent-- |
| line 59 | : | "evaportion" should be --evaporation-- |
| line 59 | : | "decreaes" should be --decreases-- |
| Column 27, line 2 | : | "pools" should be --pool-- |
| line 5 | : | "displaement" should be --displacement-- |
| line 7 | : | "increases" should be --increase-- |

UNITED STATES PATENT OFFICE

CERTIFICATE OF CORRECTION

Patent No. 4,133,058 Dated January 9, 1979

Inventor(s) William H. Baker

It is certified that error appears in the above-identified patent and that said Letters Patent are hereby corrected as shown below:

| | | |
|---|---|---|
| Column 28, line 12 | : | "e" should be --the-- |
| Column 29, line 37 | : | "sebsors" should be --sensors-- |
| Column 34, line 28 | : | "These" should be --There-- |
| Column 35, line 27 | : | "water-resistance" should be --water resistant-- |
| line 35 | : | "dirve" should be --drive-- |
| line 55 | : | "directy" should be --directly-- |
| Column 36, line 9 | : | "automatated" should be --automated-- |
| line 62 | : | "fow" should be --flow-- |
| Column 37, line 11 | : | "cosing" should be --closing-- |
| Column 40, line 6 | : | "dispostion" should be --disposition-- |
| Column 42, line 52 | : | "poll" should be --pool-- |
| Column 43, line 50 | : | "permiter" should be -perimeter-- |
| Column 45, line 61 | : | "accommodaate" should be --accommodate-- |

UNITED STATES PATENT OFFICE

CERTIFICATE OF CORRECTION

Patent No. 4,133,058 Dated January 9, 1979

Inventor(s) William H. Baker

It is certified that error appears in the above-identified patent and that said Letters Patent are hereby corrected as shown below:

Column 46, line 21 : After "thereto" please insert --to--

Column 46, line 23 : "incresed" should be --increased--

Column 48, line 15 : "excesive" should be --excessive--

Column 49, line 14 : "thirrd" should be --third--

Signed and Sealed this

*Eleventh* Day of *September 1979*

[SEAL]

*Attest:*

*Attesting Officer*

LUTRELLE F. PARKER

*Acting Commissioner of Patents and Trademarks*